US005695003A

United States Patent [19]

Ashton, III et al.

[11] Patent Number: 5,695,003

[45] Date of Patent: Dec. 9, 1997

[54] SYSTEM FOR SEALING THE NOZZLE OF A STEAM GENERATOR

[75] Inventors: Augustus T. Ashton, III, Westboro; Ann Ferriter, Burlington; Robert F. Riemer, Andover, all of Mass.

[73] Assignee: Foster-Miller, Inc., Waltham, Mass.

[21] Appl. No.: 277,482

[22] Filed: Jul. 19, 1994

[51] Int. Cl.[6] ..... F28F 7/00

[52] U.S. Cl. ..... 165/76; 138/89; 138/93; 376/204; 376/260

[58] Field of Search ..... 165/76, 71; 220/314, 220/232; 138/89, 93; 376/204, 260

[56] References Cited

U.S. PATENT DOCUMENTS

| | | | |
|---|---|---|---|
| 4,285,368 | 8/1981 | Terrill et al. | 138/89 |
| 4,393,899 | 7/1983 | Tsuji et al. | 138/89 |
| 4,548,783 | 10/1985 | Dalke et al. | 376/204 |
| 4,591,477 | 5/1986 | Rettew | 376/204 |
| 4,625,766 | 12/1986 | Dohlen et al. | 138/93 |
| 4,637,588 | 1/1987 | Wilhelm et al. | 138/93 |
| 4,671,326 | 6/1987 | Wilhelm et al. | 138/93 |
| 4,690,172 | 9/1987 | Everett | 138/89 |
| 5,164,151 | 11/1992 | Shah et al. | 376/260 |
| 5,171,514 | 12/1992 | Veronesi et al. | 376/204 |
| 5,421,369 | 6/1995 | Wivagg et al. | 138/89 |

FOREIGN PATENT DOCUMENTS

| | | | |
|---|---|---|---|
| 3435552 | 4/1986 | Germany | 138/89 |

*Primary Examiner*—Leonard R. Leo
*Attorney, Agent, or Firm*—Iandiorio & Teska

[57] ABSTRACT

A system for sealing the nozzle of a steam generator including a collapsible nozzle dam and an installation pivot arm. The collapsible nozzle dam includes a base portion receivable through a manway in the steam generator for retaining an inflatable seal in place within the nozzle, a post extending from the base portion, a plurality of foot assemblies positioned radially about the post for engaging a nozzle ring around the nozzle of the steam generator, a truss structure for supporting the foot assemblies with respect to said base portion including compression legs interconnecting the foot assemblies with the base portion and tension legs interconnecting the foot assemblies with the post. The foot assemblies fold about the post for insertion thereof through the manway to unfold once inside the steam generator for engaging the nozzle ring and positioning the base portion within the nozzle. The installation pivot arm transports the collapsible nozzle dam from the manway to the nozzle and includes a support having a proximal end securable to the manway of the steam generator and a distal end securable to the nozzle ring, a nozzle dam attachment and positioning backing plate, and a four bar linkage.

57 Claims, 17 Drawing Sheets

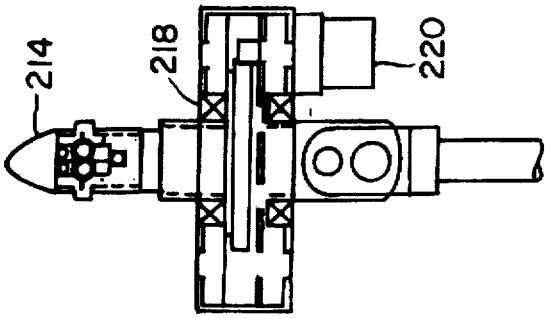
FIG. 11
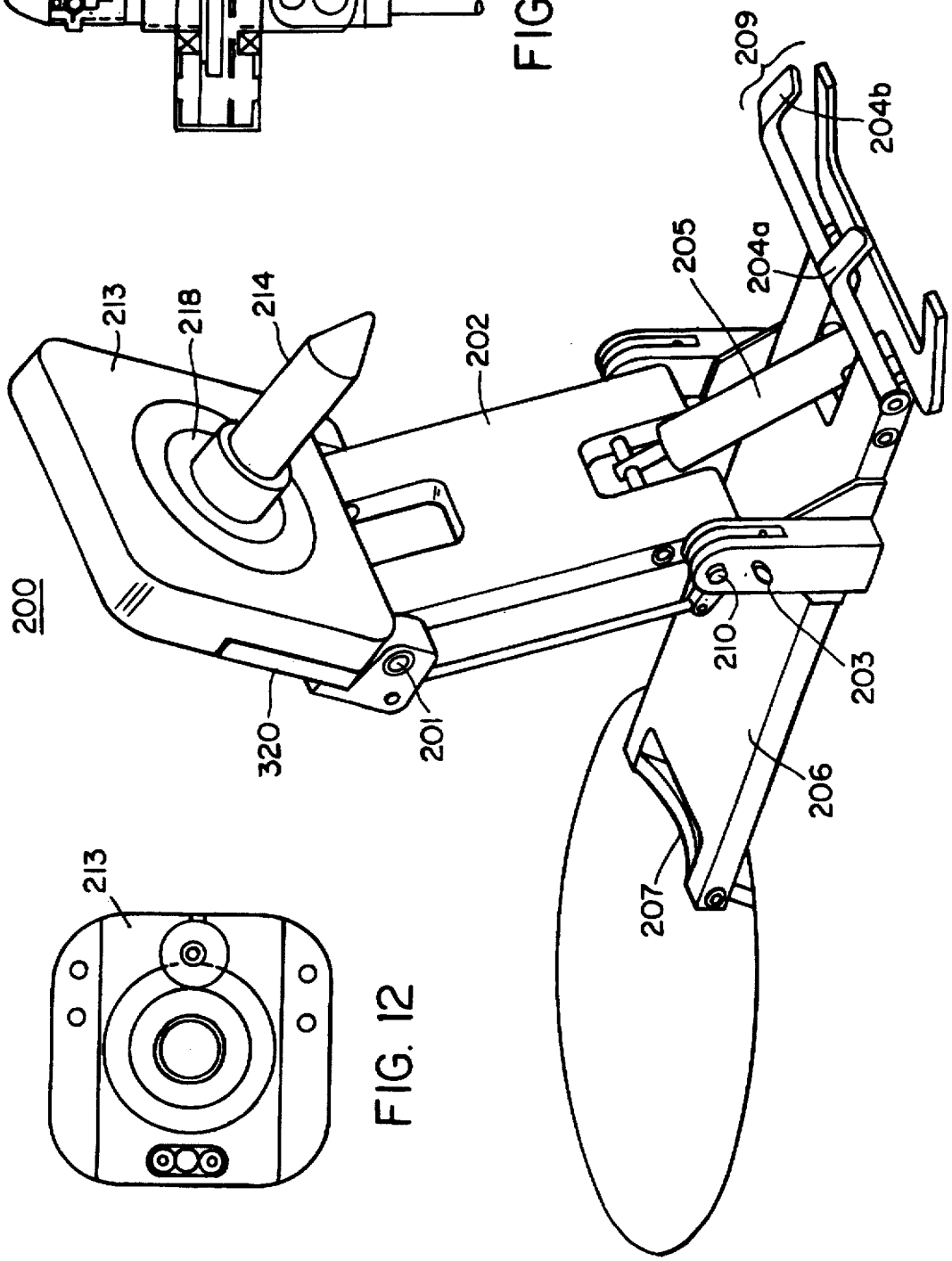
FIG. 10
FIG. 12

SYSTEM FOR SEALING THE NOZZLE OF A STEAM GENERATOR

FIELD OF INVENTION

This invention relates to a system for sealing the nozzle of a steam generator in which a collapsible nozzle dam is inserted through the manway of a steam generator bowl and transported over to the nozzle using an installation pivot arm and then fixed in place within the nozzle to support an inflatable seal for sealing the nozzle during reactor refueling operations.

BACKGROUND OF INVENTION

During a refueling outage at a pressurized water reactor, one of the first activities to be conducted on the critical path is to flood the refueling cavity so that nuclear fuel can be safely moved under water. While refueling, it is necessary to perform numerous other tasks such as eddy current testing, tube plugging, and tube sleeving on the primary side of the steam generator of the reactor. To perform these tasks, the steam generator has to be isolated from the primary loop to prevent it from filling with the water used to flood the refueling cavity. To isolate the steam generator, nozzle dams are installed in the inlet and outlet nozzles of the steam generator leading to the reactor.

Nozzle dams are typically 30" to 50" in diameter, depending on the steam generator they are to be installed in. The nozzle dams are typically designed to withstand 20 psi of water pressure, representing 45 feet of static water head from the refueling cavity. Failure of the dam to withstand this pressure puts the equipment and personnel working in the steam generator at severe risk and also could result in the release of thousands of gallons of water from the refueling cavity.

One current practice is to install nozzle dams manually. Access to the steam generator bowl is through a 16" manway located in both the inlet and outlet plenums. Workers who have to enter these chambers to install the dams wear multiple sets of anticontamination clothing, air fed hoods, and extra radiation detectors. Installation of nozzle dams is acknowledged to be one of the most dangerous and radiation intensive tasks in a typical refueling outage. The radiation fields within the steam generator bowls are very high, generally 5 to 25 Rem/hr. Due to the high levels of radiation, the tight confines of the steam generator bowl, and the complexity of dam installation, a nozzle dam installation team can receive a radiation exposure of up to 20 Rem. This exposure constitutes one of the largest single contributors to radiation exposure during the refueling outage. In addition, personnel are also potentially exposed to "hot" particles called "nuclear fleas". Decontamination of a worker exposed to these nuclear fleas is difficult, time consuming, and expensive.

Aside from potential hazards to workers, the nozzle dam installation is normally on the critical path for outage. Utilities value outage time at $500,000.00 per day. Problems or delays during the installation of nozzle dams impacts this critical path.

One primary engineering factor involved in the installation of the nozzle dam is that the nozzle area to be sealed is typically 40" to 50" in diameter while the manway through which the nozzle dam must pass to be inserted over the nozzle is typically only 16" in diameter. Hinged folding nozzle covers which fit through the manway in a folded configuration and then unfold to be manually affixed to cover the nozzle are known. See e.g., U.S. Pat. No. 5,006,302. As explained above, however, such manual procedures expose the workers to excessive radiation exposure.

Another engineering factor is that once the nozzle dam is installed, any associated installation equipment must be removed from the steam generator bowl, otherwise, the nozzle dam installation equipment would interfere with the steam generator inspection equipment. Also, the nozzle dam itself should not rise to any significant elevation above the plane of the nozzle opening, otherwise the nozzle dam itself will interfere with inspection equipment. An additional factor to be considered in the design of a nozzle dam and nozzle dam installation equipment is that the low ceiling of the steam generator bowl limits the space available for manipulating and positioning the nozzle dam.

A nozzle dam must withstand the pressure tolerances described above. Nozzle dams which are not actually bolted down over the nozzle may not be able to meet the pressure requirements. However, bolting the nozzle dam onto the nozzle requires manual labor and hence radiation exposure.

Collapsible nozzle dams installed by robotic arms are known, see e.g., U.S. Pat. No. 5,042,861, but they involve a rather lengthy installation process. In addition, since the operators of the robot arms must be located very close to the generator for fairly long periods of time, they can receive as much radiation as workers who actually enter the generator bowl and install a nozzle dam manually.

Other prior methods of sealing the nozzle include a folding nozzle cover plate inserted over the nozzle using a block and tackle arrangement and bolted in place using a long handled rachet. See e.g., U.S. Pat. Nos. 5,006,302 and 5,042,861. U.S. Pat. Nos. 5,032,350 and 4,954,312 show a robotic arm affixed to the ceiling of the steam generator bowl and used to transport a three part nozzle dam. Moreover, a friction fit nozzle dam is shown in U.S. Pat. No. 4,637,588.

The industries experience with using robotic nozzle dam installation procedures has indicated a number of shortcomings. The robotic arm has been used to remotely install nozzle dams at several United States utility sites. The time required for robotic arm installation of nozzle dams, however, significantly exceeds the time for manual installations of the dams. Manual dam installation normally takes approximately 12 to 16 hours. Robotic arm installation of the nozzle dam can be expected to take over 72 hours. Since, as explained above, nozzle dam installation is often on the critical path of plant outage and critical path outage time is valued at approximately $500,000.00 per day, the use of robotic arm installation techniques can significantly increase the time of a planned critical path outage.

As discussed above, the driving force for robotic installation of nozzle dams is reduction of radiation exposure. Because robotic installation is almost seven times as long as manual installation, radiation exposure from the robotic arm installation is almost the same as for manual. While the operator of the robotic arm is outside the radiation area, a support person is stationed at the steam generator manway where radiation levels are still significant. In addition, personnel receive exposure while moving the robotic arm and support equipment between steam generator manways. While personnel are not required to enter the high radiation areas in the steam generator channel head, they spend too long in the lower radiation areas around the steam generators.

SUMMARY OF INVENTION I

It is therefore an object of this invention to provide a system for sealing the nozzle of a steam generator which provides for fast and remote installation of a nozzle dam thereby dramatically reducing radiation exposure by decreasing the installation duration and system complexity as compared to robotic arm installation techniques.

It is a further object of this invention to provide such a system for sealing the nozzle of a steam generator which uses a nozzle dam positively engaged about the nozzle thereby overcoming the risk inherent in using friction fit designs.

It is a further object of this invention to provide such a system for sealing the nozzle of a steam generator which attaches to the existing seal ring of a typical steam generator bowl thereby eliminating the need for any modifications to the generator for remote installation.

It is a further object of this invention to provide such a system for sealing the nozzle of a steam generator which can be operated by personnel without extensive training and without the need for highly specialized maintenance personnel required for installation using a robotic arm.

It is a further object of this invention to provide such a system for sealing the nozzle of a steam generator which reduces costs, outage time, and radiation exposure.

This invention features a system for sealing the nozzle of a steam generator in which a truss structure is used to support an inflatable sealing bag positioned in the nozzle. The truss structure is a unitary nozzle dam which collapses to fit through the manway of the steam generator bowl. An installation pivot arm transports the nozzle dam with the inflatable sealing bag attached thereto from the manway over the nozzle where the nozzle dam is unfolded and bolted to the nozzle ring surrounding the nozzle which securely supports the inflated seal bag within the nozzle.

This invention results from the realization that exposure to radiation can be reduced and effective sealing of a nozzle in a steam generator bowl can be accomplished by a nozzle dam assembly which collapses to fit through the manway of the steam generator and then unfolds to positively engage the nozzle ring once the nozzle dam is inside the steam generator. This invention results from the further realization that complex robotic nozzle dam insertion assemblies are no longer needed, but, instead a pivoting arm can be used to transport the nozzle dam from the manway to the nozzle and removed once the nozzle dam is in place thereby eliminating any interference with the inspection equipment used inside of the steam generator bowl once the nozzle dam is in place. Another aspect of this invention results from the realization that a simple inflatable seal can be used to seal the nozzle if the seal is supported by a base support plate small enough to fit through the manway and secured to the nozzle ring surrounding the nozzle. Yet another aspect of this invention results from the realization that remotely actuated wedge bolts can be used to firmly secure the base plate to the nozzle ring and that the wedge bolts can be assembled within collapsible arms attached to the base support plate which fold up during insertion and removal of the nozzle dam to a volume which fits through the manway.

This invention features and may suitably comprise include, consist essentially of, and/or consist of a system for sealing the nozzle of a steam generator. The system comprises a collapsible nozzle dam including a base portion receivable through a manway in the steam generator for retaining an inflatable seal in place within the nozzle, a post extending from said base portion, a plurality of foot assemblies positioned radially about the post for engaging a nozzle ring around the nozzle of the steam generator, means for supporting the foot assemblies with respect to the base portion including means for interconnecting the foot assemblies with the base portion and the post, and means for folding said foot assemblies about the post for insertion thereof through the manway and for unfolding the foot assemblies once inside the steam generator for engaging the nozzle ring and positioning the base portion within the nozzle. The system also includes an installation pivot arm for transporting the collapsible nozzle dam. The installation pivot arm includes a support having a proximal end securable to the manway of the steam generator and a distal end securable to the nozzle ring, nozzle dam attachment and positioning means, and means for articulating the nozzle dam attachment and positioning means and a nozzle dam attached thereto between a position proximate the manway and a position over the nozzle for transporting the nozzle dam from the manway to the nozzle and positioning the nozzle dam thereon.

A foot assembly includes at least one wedge bolt subassembly comprising a threaded shaft receivable by threaded holes in the nozzle ring and a pin removably insertable in the threaded shaft. A wedge bolt subassembly further includes means for actuating and deactuating the threaded shaft. The wedge bolt subassembly includes a body portion receivable within the foot assembly for positioning the threaded shaft, the body portion having a piston cavity, a piston containing the pin, the piston residing within the piston cavity, and means for driving the piston up and down within the piston cavity for actuating and deactuating the threaded shaft. The means for driving the piston up and down within the piston cavity includes a first inlet in the body portion having a port proximate the top of the piston for driving the piston down within the piston cavity and second inlet having a port proximate the bottom of the piston for driving the piston up within the piston cavity.

The system further includes means for providing compliance for the threaded shaft along its longitudinal axis for overcoming any misalignment of the threads of the threaded shaft with the threads of the threaded hole in the nozzle ring. The means for providing compliance include spring means positioned within the body portion about the threaded shaft. The system further includes means for providing compliance between the body portion and the foot assembly for overcoming any axial misalignment of the threaded shaft with the holes in the nozzle ring. The means for providing compliance between the body portion and the foot assembly includes spring means inserted between the body portion and the foot assembly.

The means for supporting the foot assembly includes a compression leg for each foot assembly, each compression leg extending between the base portion and its associated foot assembly. There is first pivot means for pivoting the compression leg with respect to the base portion and a second pivot means for pivoting the compression leg with respect to its associated foot assembly. At least one compression leg includes a short link for shortening the span of travel of its associated foot assembly.

The means for interconnecting the foot assemblies with the base portion and the post further includes a tension leg assembly for each foot assembly, each tension leg assembly extending between the post and its associated foot assembly. There are means for providing compliance between a foot assembly and the tension leg assembly. The system includes a collar assembly slidable along the post interconnected with the tension leg assemblies. The means for folding includes means for driving the collar assembly up and down along the post. The means for driving includes a power driven screw residing in the post, the driving screw includes means for engaging the collar assembly for moving the collar assembly along the post as the driving screw turns. The driven screw is powered by a motor residing in the base portion.

The proximal end of the installation arm includes a clamp for engaging the manway opening; and the distal end of the installation arm includes at least one articulating finger for engaging the nozzle ring. The nozzle dam attachment means includes an actuator for aligning the foot assemblies with the nozzle ring threaded holes. The means for articulating the nozzle dam attachment means includes a four bar linkage pivotably attached on one end thereof to the platform and having the nozzle dam attachment means affixed to the other end thereof. The platform may be extendable to accommodate varying distances between the manway and the nozzle in different steam generators. The means for articulating further includes a pneumatic cylinder extending between the four bar linkage and the platform. The nozzle dam attachment means includes means for rotating the nozzle dam and means for releasably and remotely engaging the nozzle dam.

The system includes an inflatable seal attachable to the base portion of the nozzle dam for sealing the nozzle and a push rod for urging the pivot arm into position for transporting the nozzle dam over to the nozzle.

This invention also features a collapsible nozzle dam for use in a system for sealing a nozzle in a steam generator, the nozzle dam comprising: a base portion receivable through a manway in the steam generator; means for supporting the base portion about the nozzle of a steam generator; and means for folding the support means to a volume which fits through the manway and for unfolding the support means when the nozzle dam is inside the steam generator, the base portion, the support means, and the means for folding integral thereby forming a unitary nozzle dam.

The collapsible nozzle dam comprises a base portion receivable through a manway; a number of pivoting arms attached to the base portion extendable to reach the periphery of a nozzle larger in diameter than the manway and foldable to fit through the manway; and a foot assembly for each arm on the distal end thereof, each foot assembly including means for automatically engaging the periphery of the nozzle for supporting the base portion in the nozzle when the arms are extended.

A wedge bolt assembly is featured for releasably engaging the foot assembly about the nozzle ring, the wedge bolt assembly comprising a body portion affixed to a threaded shaft, the body portion receivable within the foot assembly for positioning the threaded shaft, the body portion having a piston cavity, a piston containing a pin, the piston residing within the piston cavity; and means for driving the piston up and down within the piston cavity for actuating and deactuating the threaded shaft.

The means for driving the piston up and down within said piston cavity includes a first inlet in the body portion having a port proximate the top of the piston for driving the piston down within the piston cavity and a second inlet having a port proximate the bottom of the piston for driving the piston up within the piston cavity. The wedge bolt assembly includes means for providing compliance for the threaded shaft along its longitudinal axis for overcoming any misalignment of the threads of threaded shaft with the threads of a threaded hole in the nozzle ring. The means for providing compliance includes spring means positioned within the body portion about the threaded shaft. The wedge bolt assembly further includes means for providing compliance between the body portion and the foot assembly for overcoming any axial misalignment of the threaded shaft. The means for providing compliance between the body portion and the foot assembly includes spring means inserted between the body portion and the foot assembly.

This invention also features an installation pivot arm for transporting a collapsible nozzle dam, the installation pivot arm comprising a support with a proximal end securable to a manway of a steam generator and a distal end securable to a nozzle ring; nozzle dam attachment and positioning means and means for articulating the nozzle dam attachment means and a nozzle dam attached thereto to between a position proximate the manway and a position over the nozzle for transporting the nozzle dam from the manway to the nozzle.

The proximal end of the installation arm includes a clamp for engaging a manway opening. The distal end of the installation arm includes at least one articulating finger for engaging the nozzle ring. The nozzle dam attachment means includes an actuator for aligning the nozzle dam. The means for articulating the nozzle includes a four bar linkage pivotably attached on one end thereof to the support and having the nozzle dam attachment means affixed to the other end thereof.

The support is extendable to accommodate varying distances between the manway and the nozzle in different steam generators. The means for articulating further includes a pneumatic cylinder extending between the four bar linkage and the support. The nozzle dam attachment means includes means for rotating a nozzle dam attached thereto and means for releasably and remotely engaging the nozzle dam.

DISCLOSURE OF PREFERRED EMBODIMENT

Other objects, features and advantages will occur to those skilled in the art from the following description of a preferred embodiment and the accompanying drawings, in which.

Figure 4:
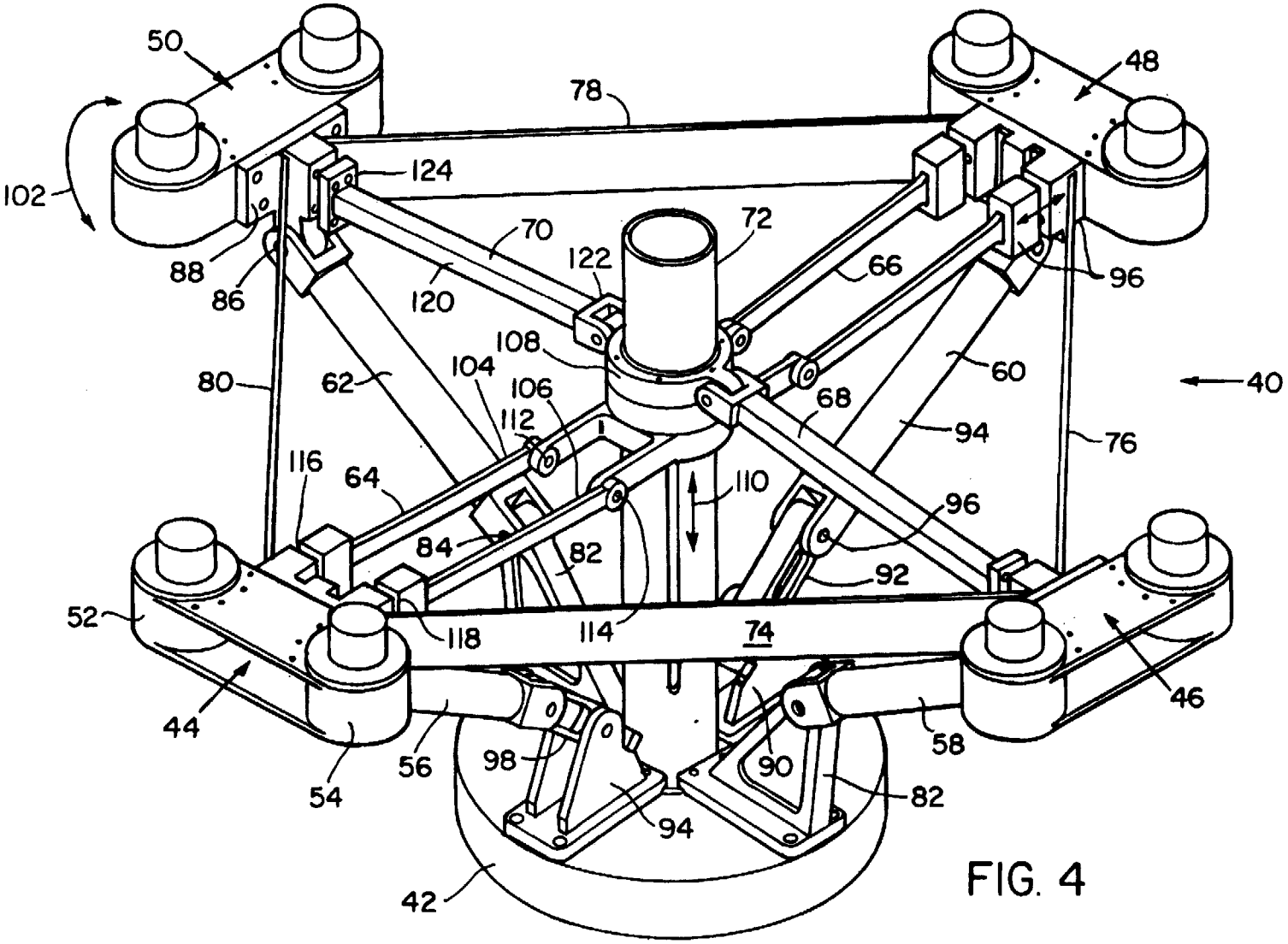
FIG. 4 is a three dimensional view of the collapsible nozzle dam of the subject invention.
Figure 5:
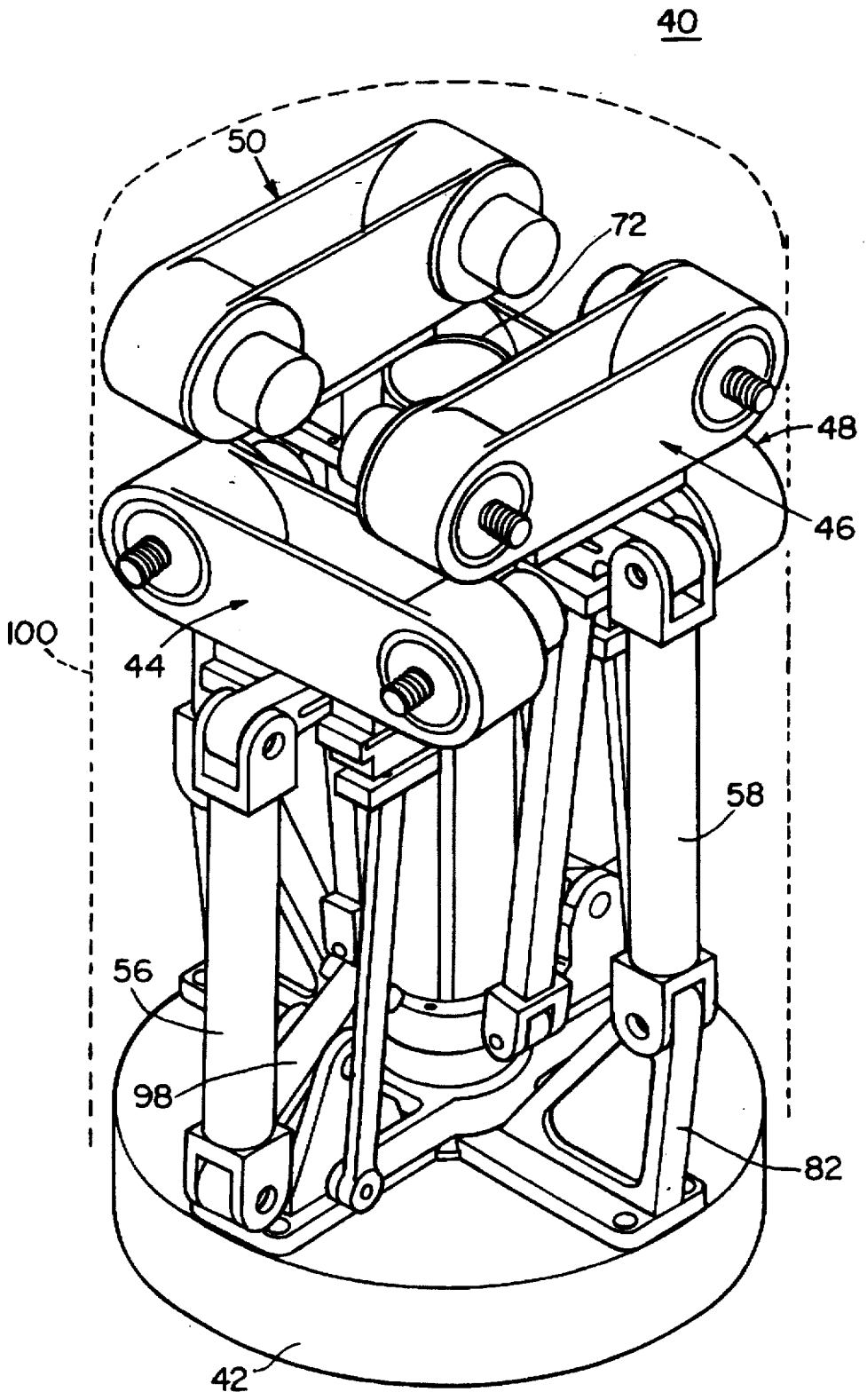
FIG. 5 is a three dimensional view of the nozzle dam of FIG. 4 shown in its folded configuration for insertion through a manway.

FIG. 10 is a three dimensional schematic view of the installation pivot arm subassembly used for installing the collapsible nozzle dam shown in FIGS. 4 and 5 inside the steam generator bowl; and FIGS. 11–12 are schematic views of the dam backing portion of the pivot arm shown in FIG. 10; and FIGS. 13–21 are schematic diagrams showing the procedure and the method for installing the collapsible nozzle dam according to this invention.

Figure 1:
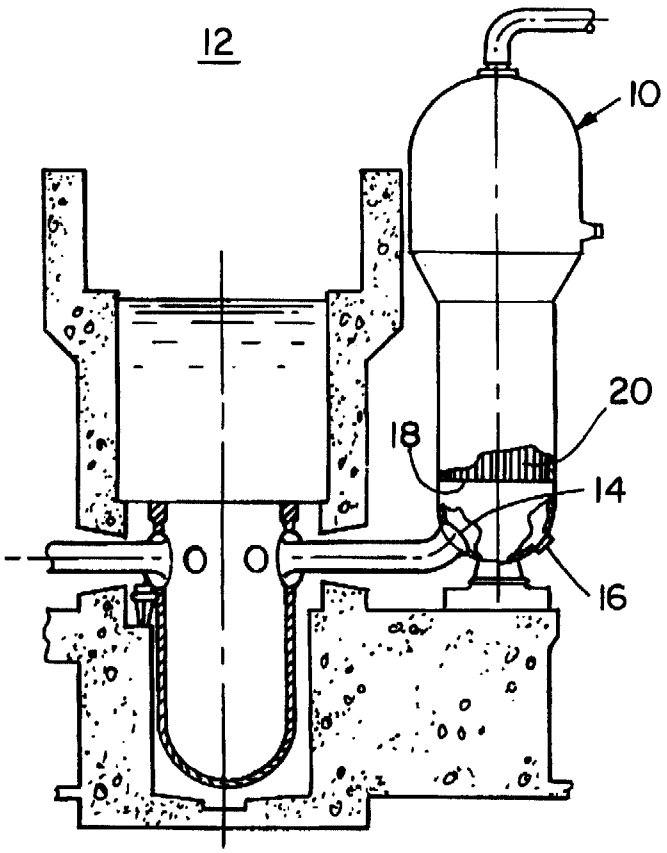
FIG. 1 is a schematic diagram of a typical reactor/steam generator refueling cavity arrangement.

Steam generator 10, FIG. 1, of reactor 12 has nozzle 14 which must be sealed during the refueling efforts as described in the Background of Invention above. It is known in the industry to insert a nozzle dam through manway 16 and then secure the nozzle dam to seal nozzle 14. Although this sounds fairly straight forward, it is not. Manway 16 typically has a diameter of 16" while nozzle 14 has a diameter ranging from 30"–50" depending on the manufacturer. As a result, a one piece dam cannot be used. In addition, ceiling 18 of the steam generator bowl at the bottom of the heat tube section 20 is rather low leaving little room for nozzle dam manipulation and orientation. The nozzle ring 24, FIG. 2, which surrounds the nozzle of generator 10, FIG. 1, typically includes twenty bolt holes such as bolt holes 32, 34, etc as shown. These bolt holes are used to positively secure the collapsible nozzle dam of this invention within the nozzle.

As discussed in the Background of Invention above, the goal is to adequately seal nozzle 14 without exposing workers to excessive amounts of radiation, to reduce outage costs, and to remove any nozzle dam insertion tools to facilitate thorough inspection of generator 10.

Figure 3:
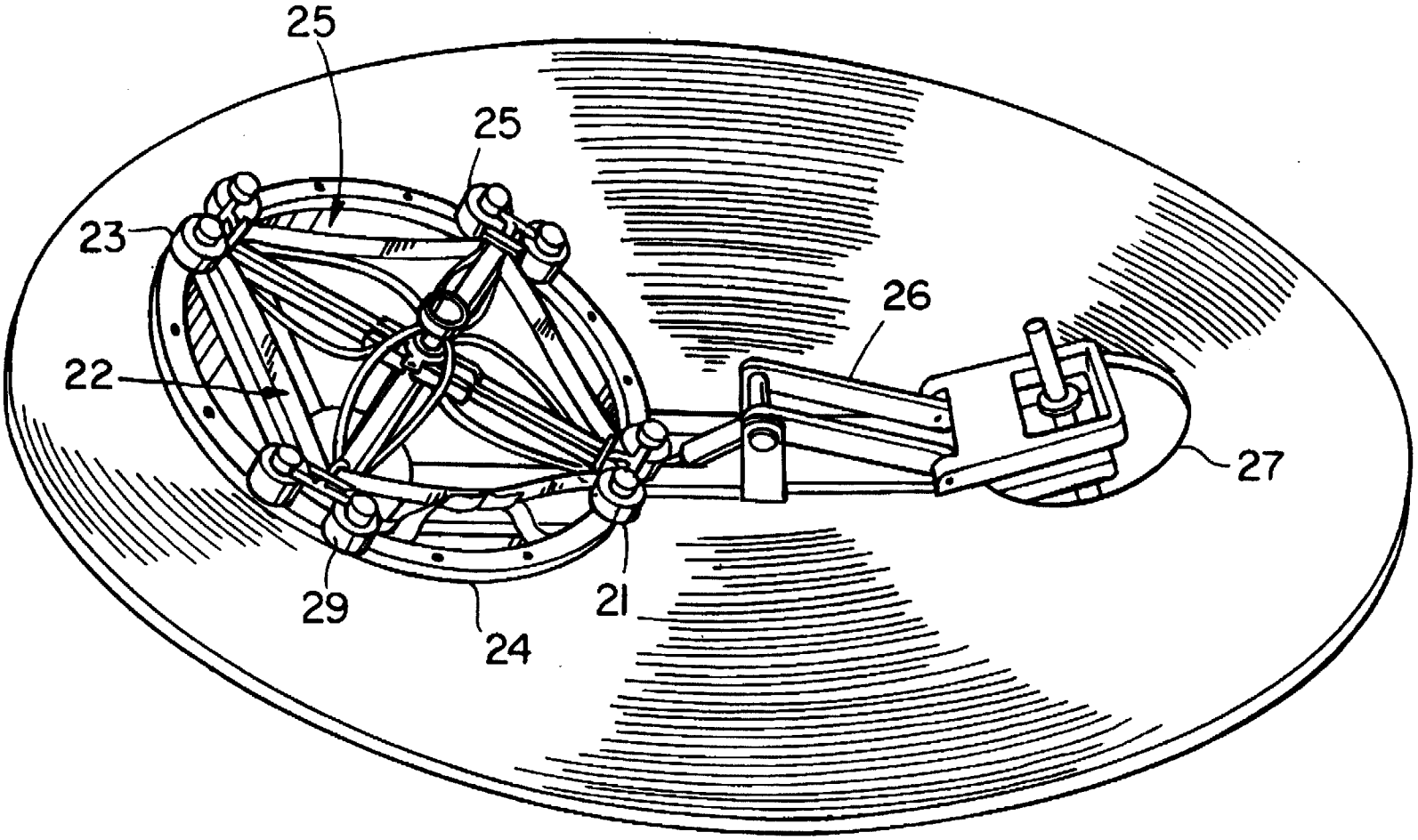
FIG. 3 is a schematic diagram showing the system for sealing the nozzle of the steam generator of FIG. 1 according to this invention.

The major subassemblies of the system according to this invention for sealing nozzle 14 of steam generator 10 are shown in FIG. 3 and include a collapsible nozzle dam 22 which supports an inflatable sealing bag (not shown) within the nozzle. Nozzle dam 22 is positively engaged with nozzle ring 24 surrounding nozzle 25, and installation pivot arm subassembly 26 which extends between nozzle 25 and manway 27 transports collapsible nozzle dam 22 in its collapsed position through the manway and over to the nozzle where it is unfolded for installation with the nozzle ring. Collapsible nozzle dam 22 includes four foot assemblies 21, 23, 25, and 29 which positively lock the nozzle dam about nozzle ring 24 by means of two wedge bolt subassemblies included in each foot assembly. Pivot arm 26 includes a base section, a four bar linkage, a backing piece, and a grab/release mechanism subassemblies described in detail below. Each subassembly is described in turn.

The Nozzle Dam

Nozzle dam subassembly 40, FIG. 4, includes base 42 which has a diameter of 15.5" and can therefore be received through a typical manway. One feature of nozzle dam 40 is that it is complete. That is, everything required to provide an adequate seal of the nozzle is included with assembly 40 and yet the whole assembly can be folded to a diameter less than or equal to that of base 42. This allows the whole assembly to fit through the manway eliminating any need for piecing together a three part nozzle dam inside of the steam generator as was attempted in the prior art.

Foot assemblies 44, 46, 48 and 50 each include two wedge bolt assemblies 52 and 54 as shown for foot assembly 44. These assemblies position and drive wedge bolts into the bolt holes of nozzle seal ring 24, FIG. 3. The details of the wedge bolted assemblies and the wedge bolts themselves are discussed with respect to FIGS. 7, 8, and 9 below.

Each foot assembly is maintained in position about the nozzle seal ring by means of compression legs 56, 58, 60 and 62 which foldably extend between base 42 and each foot assembly. Tension leg assemblies 64, 66, 68 and 70 are capable of spanning from post 72 extending upward from base 42 to each foot assembly. Kevlar belt sections 74, 76, 78 and 80 distribute the sheer load experienced by the foot assemblies during loading and yet are flexible to allow the foot assemblies to be folded up about post 72.

Compression legs 58 and 62 are identical, therefore only compression leg 62 will be discussed in detail. Compression leg 62 is mounted on base 82 by pivot means 84 and mounted to foot assembly 50 by pivot means 86 which forms a part of foot assembly frame 88.

Compression legs 56 and 60 are also identical, therefore only compression leg 60 will be discussed in detail. Compression leg 60 is formed by short link section 92 and main arm section 94. Short link section 92 is pivotally attached as shown to main arm 94 at one end and pivotally attached to base 90 at its other end. Main arm 94 is pivotally attached to foot assembly 48 at frame 96. Short link section 92 allows point 96 to be driven downward thereby allowing foot assemblies 44 and 48 to be positioned under foot assemblies 46 and 50 for a more compact folded configuration as shown in FIG. 5.

As shown in FIG. 5 for compression leg 56 with short link section 98, foot assembly 44 rests lower about post 72 than foot assembly 46 which is connected to base portion 42 by compression leg 58 which lacks the short link section. In this way, the total volume of the dam assembly represented by hatched line 100 is small enough to fit through a typical manway.

Returning to FIG. 4 with an understanding of the folded configuration shown in FIG. 5, it can be seen that each foot assembly pivots in the direction shown by arrow 102 for foot assembly 50. Tension leg assembly 64 is identical to tension leg assembly 66, therefore tension leg assembly 64 is discussed in detail. Tension leg assembly 64 includes two bars 104 and 106 linked to collar 108 by links 112 and 114. Collar 108 slides about post 72 in the direction shown by arrow 110 to fold and unfold the foot assemblies as discussed in more detail with reference to FIG. 6. Bars 104 and 106 engage foot assembly 44 by means of Bellvile washers 116 and 118 which provide compliance along the axis defined by bars 104 and 106.

Tension leg assemblies 68 and 70 are identical and include bar 120 as shown for tension leg 70 linked to collar 108 at one end 122 and bolted to foot assembly 50 at its other end 124.

Figure 2:
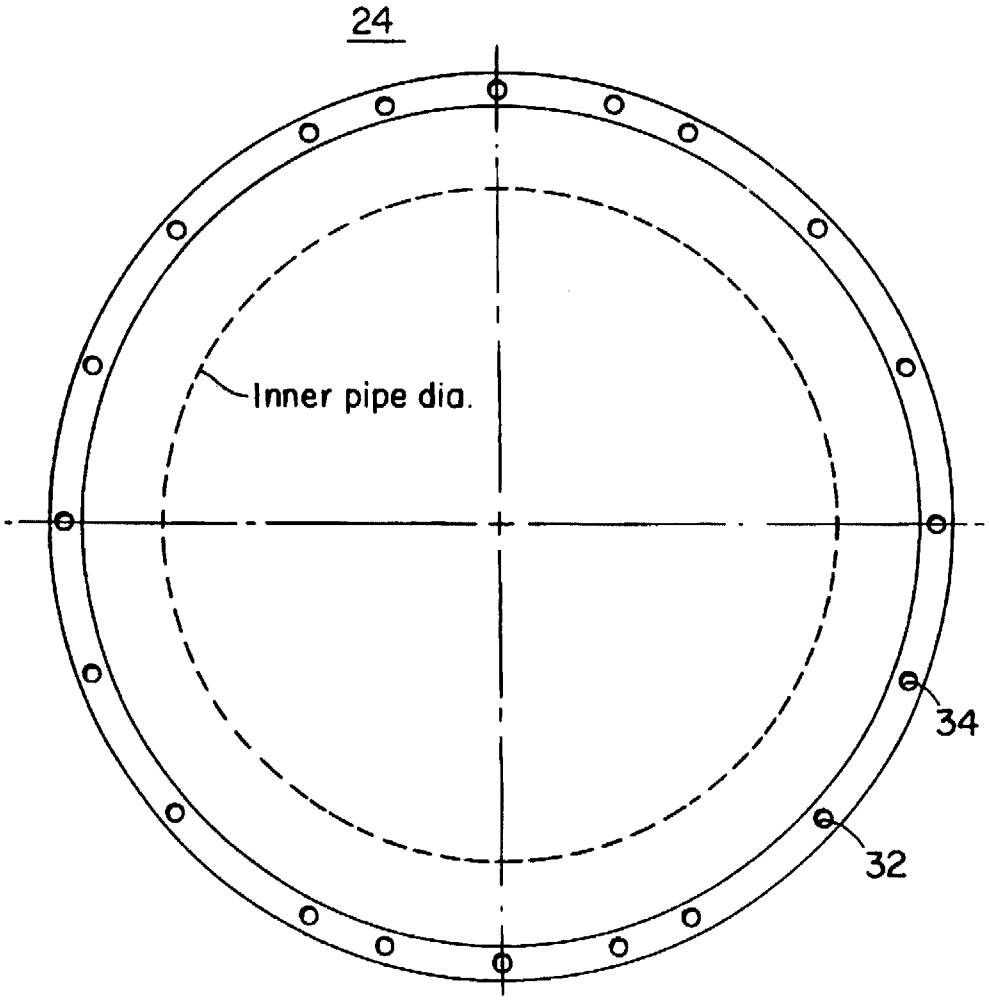
FIG. 2 is a more detailed top plan view of a nozzle seal ring which surrounds the nozzle of a typical steam generator.

In this way, dam assembly 40, FIG. 5 is able to fold into a volume which fits through manway 27, FIG. 2 and then unfolds to engage nozzle ring 24, FIG. 3.

FIG. 5 shows the closed dam. Dam structure folding is accomplished by turning screw 130, FIG. 6, internal to the center post 72. This is achieved with small dc motor 132 and a set of bevel gears 134 and 136 mounted in base 42. Screw 130 actuates a nut 138 which moves the pivot points of the tension leg assemblies 64 and 68 up and down along the length of center post 72. Nut 138 is attached to tension leg 64 by means of bolt 140 extending through slot 142 in post 72 which engages collar assembly 108. The tension leg assembly pivot points 144, 146, etc moving towards base 42, rotate foot assemblies 44, 46, 48 and 52, FIGS. 4 and 5 and draw the compression legs 56, 58, 60, 62 up against center post 72 as shown in FIG. 5.

To achieve the small fold up cross section required for insertion into the manway, two of the compression legs are offset axially when folded through the use of offset pivot point 96 shown for compression leg 60, different length tension leg assemblies 64 and 68, and additional short link 92 at the base as discussed above. Offsetting the two compression legs in this manner allows the relatively large foot assemblies of the dam support structure to be positioned so that only two foot assemblies at a time are in the same cross section passing through the manway. Despite the added complexity, the single action screw actuator simply accomplishes both the folding and unfolding. The dam support structure in its folded configuration is 26" long and will fit through a 15.25" minimum diameter manway. In its folded configuration, the smooth and rugged compression legs form the outer-most surfaces and protect the hoses and actuators of the dam (not shown) in the event that scraping or bumping occurs in the manway during handling. The folded cross section provides adequate clearance for the hoses and wiring that must fit through the manway concurrently with the dam.

Wedge Bolt Design

Figure 7B:
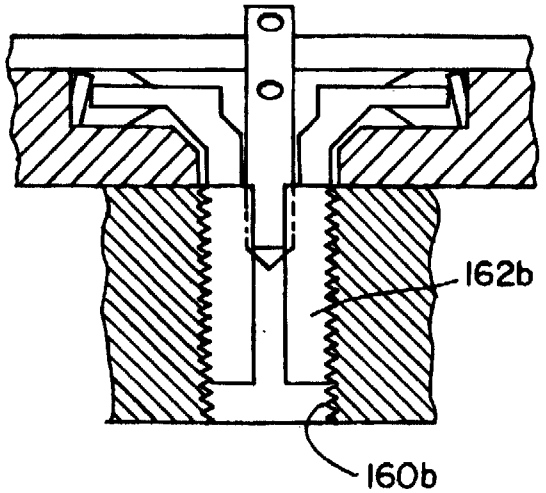
FIG. 7B is a cross sectional view of the wedge bolt assembly of FIG. 7A shown in its actuated position.
Figure 7A:
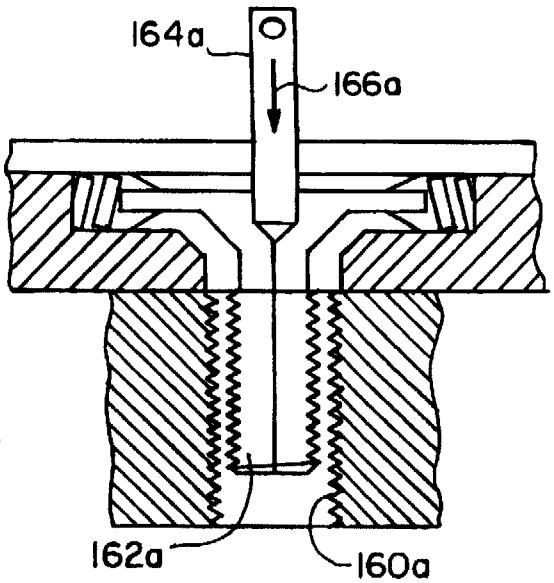
FIG. 7A is a cross sectional view of the wedge bolt used with the collapsible nozzle dam of FIGS. 4 and 5 to positively engage the nozzle seal ring shown in FIG. 2
Figure 8:
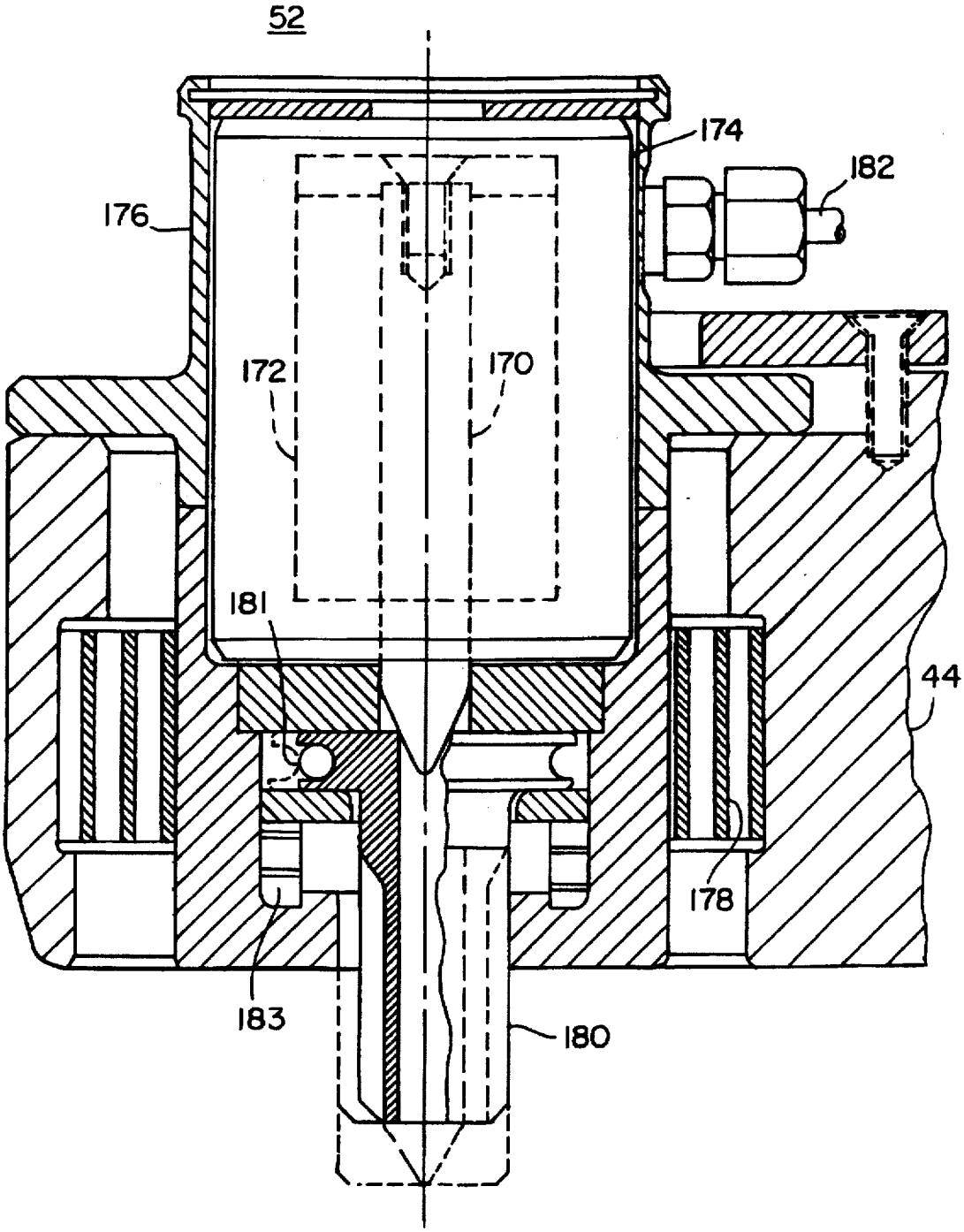
FIG. 8 is a cross sectional view of the complete wedge bolt assembly according to this invention.

FIGS. 7A and 7B schematically shows a part of a wedge bolt incorporated in wedge bolt assembly 52, FIG. 4. The goal is to firmly engage foot assembly 44 with nozzle seal ring 24, FIG. 3. A typical threaded nozzle seal ring bolt hole 160*a* is shown in FIG. 7A. Threaded shaft 162*a* is received in threaded bolt hole 160*a* as shown and then spreader pin 164*a* is driven downward therein as shown by arrow 166*a* driving threaded shaft 162*b*, FIG. 7B outward as shown. A typical wedge bolt is shown in U.S. Pat. No. 4,478,546 but in this invention, a prototype wedge bolt was fabricated from a commercially available No. ¾-10 UNC bolt grade 5 (tensile strength=120 psi). The bolt was cut into four equal sectors and the ideal maximum tensile load was calculated in tensile testing conducted to examine wedge bolt behavior. The prototype wedge bolt failed at the first thread at a force level of 14,080 lb or 80% of its ideal tensile load. On examination of the bolt and test fixture after the test, it was seen that one of the bolt sectors withstood significantly more of the test load than the other three sectors. Therefore, the wedge bolt was made by slicing a bolt into three sectors resulting in a 6% increase in overall cross sectional area over the four sector prototype. The optimized wedge bolt made of "VASCOMAX C-300" failed at a tensile load level of 29,800 lb or 67% of the ideal tensile load value but was more than double than that of the initial design. Since the dam is typically loaded at a pressure of 20 psi, each of the wedge bolts will be subjected to 2000 lb, and this design includes a safety factor of 14.8.

As described above, the nozzle dam is attached to the nozzle seal ring by eight wedge bolts located in the foot assemblies. To accomplish this, the wedge bolt assembly must provide a built in float of 0.250" to allow alignment with the seal ring holes and remote actuation to engage in the seal ring holes. The basic wedge bolt components have been designed in the self contained assembly shown in FIG. 8. Spreader pin 170 is driven by piston 172 of a remotely actuated air cylinder 174. Air cylinder 174, wedge bolt sector 180, retention spring 181, and float spring 183 is mounted in a cartridge housing 176 forming the wedge bolt subassembly.

The wedge bolt subassembly is retained, but allowed to float within the foot assembly of the nozzle dam structure. A centering spring 178 within the nozzle dam foot provides compliance and allows the wedge bolt assembly to float 0.250" from the ideal location of the seal ring threaded hole. Spring 183 provides compliance along the axis of bolt 180 allowing the threads of bolt 180 to correctly engage with the threads of the bolt hole of the sealing ring.

Figure 9B:
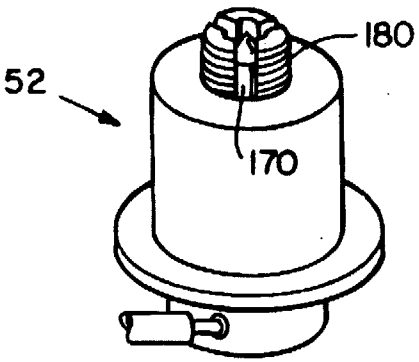
FIG. 9B is a three dimensional view of the wedge bolt assembly of FIG. 8 in its actuated position.
Figure 9A:
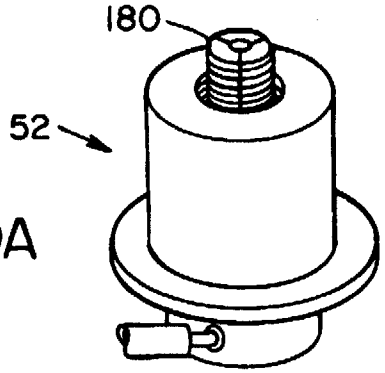
FIG. 9A is a three dimensional view of the wedge bolt assembly shown in FIG. 8 in its unactuated position.

FIG. 9A shows wedge bolt assembly 52 before pin 170 is actuated and FIG. 9B shows wedge bolt assembly 52 actuated after pin 170 is driven through wedge bolt 180. Air nozzle 182 is ported to the top of piston 172, FIG. 8, for driving piston 172 down inside housing 176 and another air nozzle (not shown) is ported to the bottom of piston 172 for driving piston 172 up thereby deactuating wedge bolt assembly 52 once the sealing operation is completed and the nozzle dam is to be removed.

In summary, the nozzle dam design comprises a sealing bag (discussed below) and the sealing bag support structure shown in FIGS. 4 and 5. The support structure is comprised of four folding legs shown in this preferred embodiment by compression legs 56, 58, 60, and 62 attached to base 42 as shown in FIG. 4. Base 42 supports the sealing bag while it is in the nozzle and the four legs transfer the axial load from the base to the foot assemblies 44, 46, 48 and 50 at the end of each leg. On the base, the leg pivot points are spaced around the periphery thereof which promotes stability and evenly distributes the load between the legs. Between adjacent legs there is either an 86.5° or 93.5° angle. These angles are dictated by the irregular tapped hole pattern of the sealing ring 34 shown in FIG. 2. This configuration permits the use of four identical and minimumly sized foot assemblies. The foot assemblies, each containing two wedge bolt subassemblies, firmly attach the dam to the nozzle sealing ring. When deployed, the nozzle dam is within the nozzle itself and protrudes upward only about 6" at the center of the ring and 3.5" at each foot assembly. In this way, the sealing structure does not interfere with the inspection equipment which operates within the steam generator bowl once the nozzle dam is in place.

The dam support structure in its deployed configuration acts as a simple truss structure for strength and weight efficiency. The axial force on the sealing bag is born by base 42. The base is sized to the maximum diameter that fits through the manway to provide a large support surface for the sealing bag. To withstand the maximum bending forces of approximately 64 kin-lb, the base is designed as a frame machined from 7075 aluminum with a ¼" thick ring and additional cross ribs (not shown). The theoretical 80 psi loading on the seal bag translates into 20,209 lb on each compressive leg. This is well under the buckling load of 84,000 lb for these 1.5" diameter, 1.25" aluminum cylinders with pinned in conditions. Each of the foot assemblies contains two wedge bolts subassemblies (discussed above) for added strength and single failure resistant redundancy. A maximum 1.5" constructed misalignment between the nozzle and the nozzle ring is accommodated by a clearance providing dog leg in the foot. The dog legs also provide a surface on which the dam can slide for self centering in the unlikely case of gross deployment misalignment. Smaller misalignments are taken up by the designed 0.25" of radial play in the housing of each wedge bolt assembly as discussed below.

The wedge bolts must be loaded primarily in tension as discussed below. To minimize moment loading on the wedge bolts, the compressive legs are orientated to directed axial load through the center of each of the wedge bolts. To minimize shear forces on the wedge bolts, the aluminum tension leg assemblies connect the feet to a sliding collar held fixed during deployment on the compressive center post. All attachments are simple pin joints. A 15,100 lb compression load through the large diameter hollow center post completes force flow in the truss structure. The tension leg assemblies, due to different angles, carry different loads of 18,021 lb and 20,621 lb.

Shear loading on the wedge bolts is further reduced by adjustable kevlar strap section 74, 76, 78 and 80 that extend around the dam structure connecting the foot assemblies as shown in FIG. 4. These strap sections preload the structure and assist the tension leg cross beams in carrying the tensile load while supplying structural redundancy. At 80 psi loading, each foot assembly will receive a 15,100 load which translate into a 7,550 pound tensile load on each wedge bolt assembly. Testing has shown each wedge bolt assembly can withstand 29,800 pounds of tensile loading.

The Installation Pivot Arm

Installation pivot arm 26, FIG. 2, is now discussed in more detail with reference to FIG. 10. Installation pivot arm 200 includes base support 206, the proximal end 207 securable to the manway as shown by means of a clamp shown in FIGS. 13–20, and the distal end 209 securable to the nozzle ring. Installation pivot arm 200 also includes nozzle dam attachment means such as back plate 213 and pivoting arm 320 (another similar arm is on the other side of back plate 213) and means for articulating the nozzle dam attached to back plate 213 between a position proximate the manway and a position over a nozzle for transporting the nozzle dam from the manway to the nozzle. An example of such means is a four bar linkage 202 and pneumatic cylinder 205 discussed in more detail below.

Installation pivot arm 200 is the mechanism that while positioned within the steam generator bowl, delivers the dam of FIG. 5 in its folded configuration where it is unfolded and locked onto the nozzle ring. Arm 200 is designed to be mechanically simple and easy to control. Accurately installing the dam arm platform 206 locates the arm pivot points 201 and 203 positively relative to the nozzle ring. Positive position with respect to the nozzle ring removes the need for actively controlling fine adjustment and greatly simplifies the mechanical design. The fixed motions are necessary to insert the nozzle dam and are accomplished with a four bar linkage 202. The arm itself remains simple with just one pneumatic cylinder 205 to control the swing of the arm. To initially set the dam arm base portion into proper position within the nozzle, three simple manual adjustments are made. First, the length of platform 206 is adjusted by compressing th double box structure clamps 204*a* and 204*b* (FIG. 10) are used to secure to the nozzle ring, and then platform 206 is clamped to the manway by means of base screw clamp 208, FIG. 13.

All three adjustments can be made outside of the steam generator bowl with a standard long handle ratchet socket wrench. The front ring clamps 204*a* and 204*b* are two simple pivoting arms that pull the base into positive engagement with the nozzle ring after it has been inserted into the steam generator bowl and butted up against the ring. Platform length adjustment allows the shortening or lengthening of the base, accommodating variations in distance between the manway and the nozzle ring. Manway clamping holds the base rigid and in line between the manway and nozzle ring. Both of these tasks are accomplished with simple screws. A miniature video camera (not shown) can be mounted on the front of the arm base to assist in proper alignment and can be used to help determine the orientation of the tapped mounting hold pattern in the nozzle ring.

Passive four bar linkage 202 accomplishes the sophisticated motions involved in swinging the dam within the tight confines of the steam generator half-hemisphere and also inserts the dam in near straight line motion into the nozzle. Precisely located gravity assistance stops 210 passively change the arms movement from that of a four bar to a simple linkage and back to a four bar linkage. During installation of the dam, air cylinder 205 regulates the motion of the linkage as the arm lowers the dam support structure onto the nozzle ring. Upon removal, cylinder 204 pushes the arm and attachment dam up out of the nozzle. The arm is constructed of mostly hollow aluminum members to be rigid and light weight. The total possible deflection due to solid body bending of members is 0.005" and the total arm weight is approximately 45 lbs. The dam backing piece 213 shown in FIGS. 11 and 12 is a separate assembly that acts as an interface between the arm and the dam. It contains two simple actuators. One actuator is a low precision dam "grab/release" mechanism 214 made up of three worm driving gear segments and it utilizes a cone for easy alignment with the center post of the dam. The other actuator 218 rotates the dam with a high ratio spur gear pair enabling alignment of the wedge bolts with the nozzle ring threaded holes. Both actuators are powered by small DC motor 220. A miniature camera (not shown) may be mounted on the dam backing piece to assist in rotational alignment and the camera should contain pan, tilt, and lighting subsystems. Backing piece 213 attaches and detaches easily to the arm via pins.

Installation Procedure/Method of Using the Invention

The procedure and methodology for using the system for sealing the nozzle of a steam generator of this invention is described as follows with reference to FIGS. 13–21. After the manway cover is removed, FIG. 13, the arm base 206 is inserted into the steam generator hemisphere 302. The nose 304 of the arm base 206 is slipped forward and adjusted to meet the nozzle ring FIG. 14. A miniature CCD camera (not shown) mounted on the front end of the arm base assists in accurate positioning. The camera is also used to determine the tapped hole orientation of the nozzle ring. The appropriate ring clamps 204 bring the arm base platform 206 into positive engagement with the ring. The base length is then adjusted to accommodate construction tolerances. The base 206 is then clamped to the manway flange 308 using clamp 208, FIG. 14 and 15.

Figure 13:
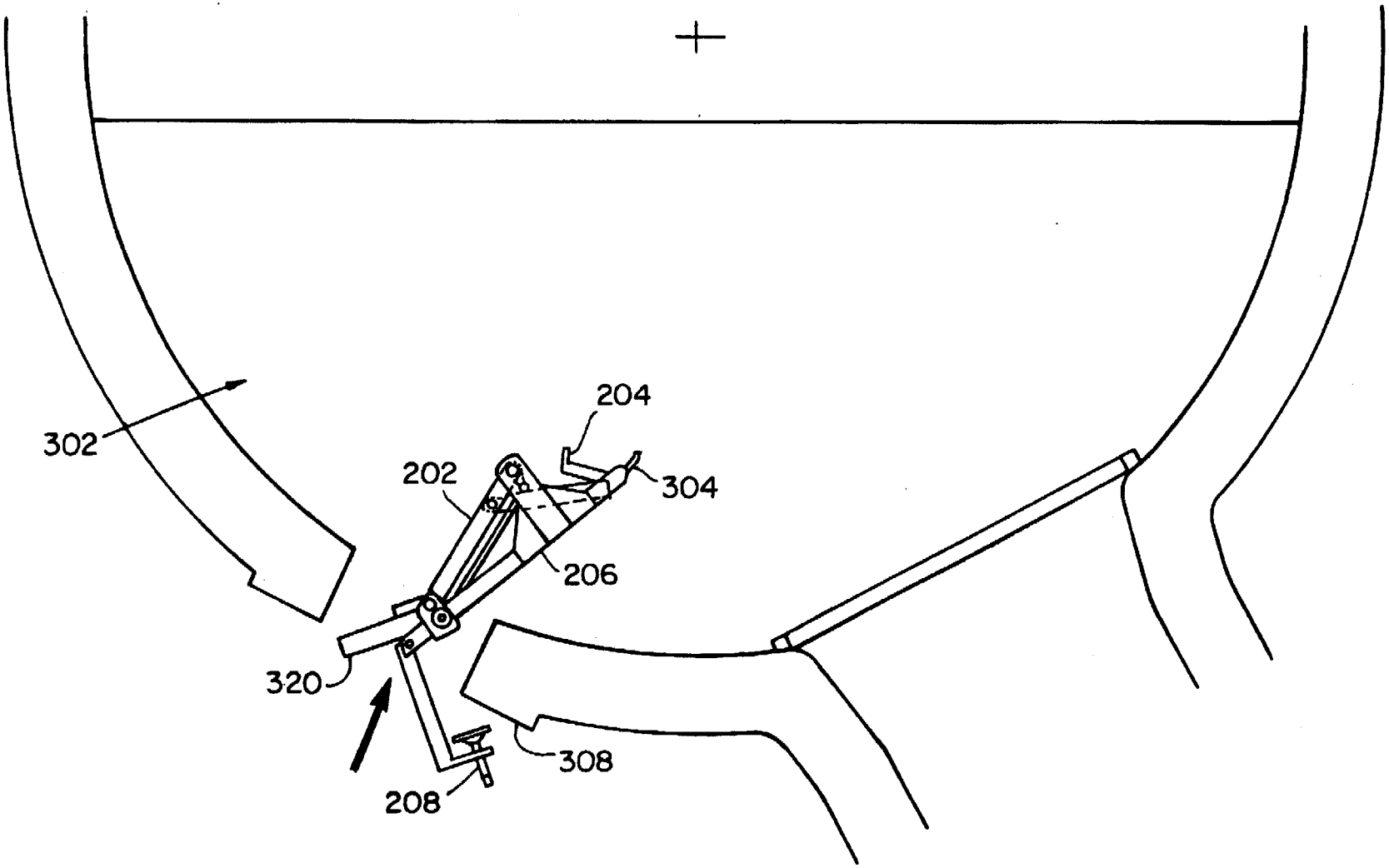
Figure 14:
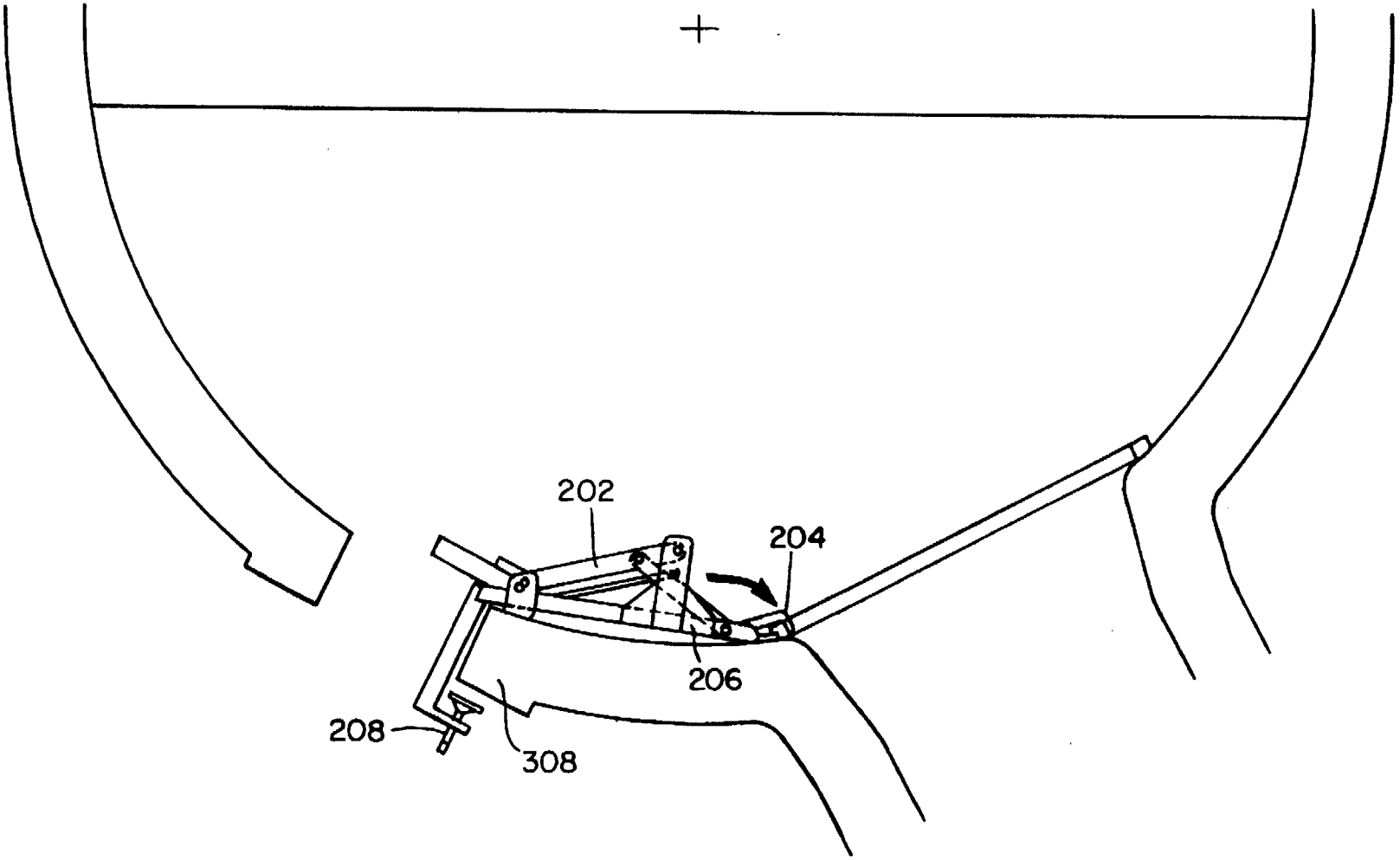
Figure 15:
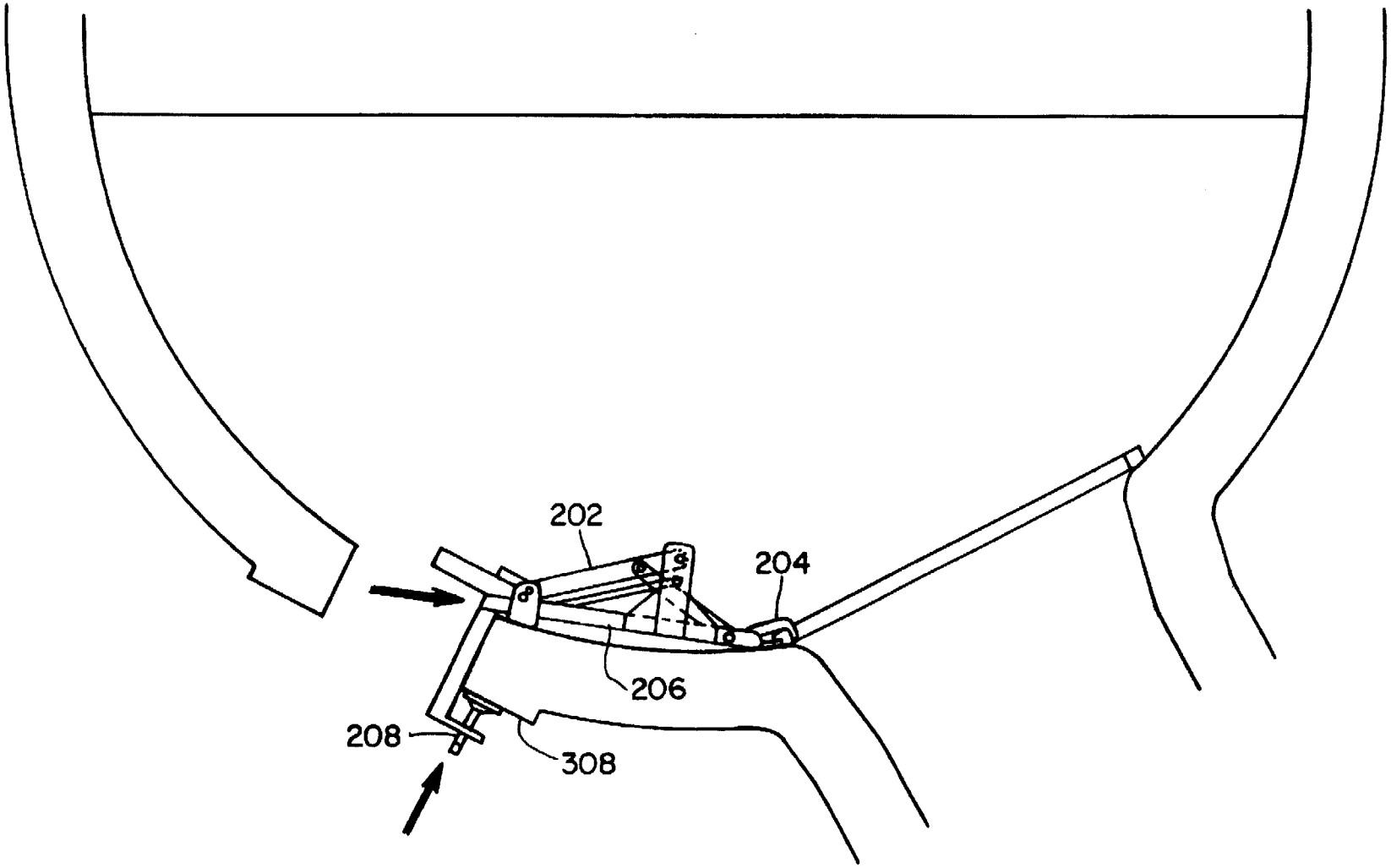
Figure 16:
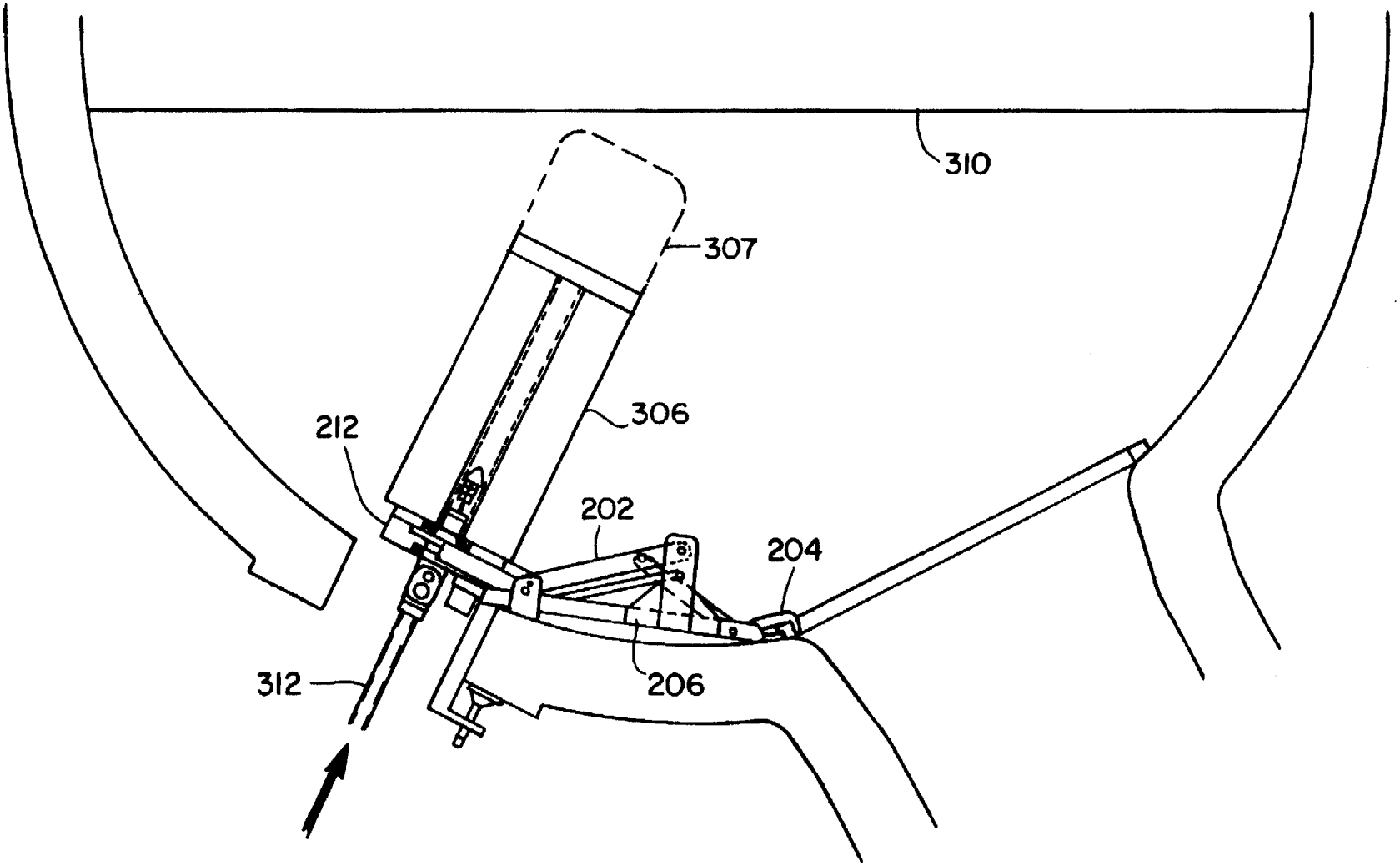

The nozzle dam, represented in FIG. 16 by structure 306, with seal 307 is inserted into the steam generator bowl. The spring-loaded dam attachment arms 320, FIG. 13 are passively pushed aside by the dam as it is inserted and then swing back under the dam. The dam backing piece 212 is quick bolted to the attachment arm as shown in FIG. 16.

Figure 17:
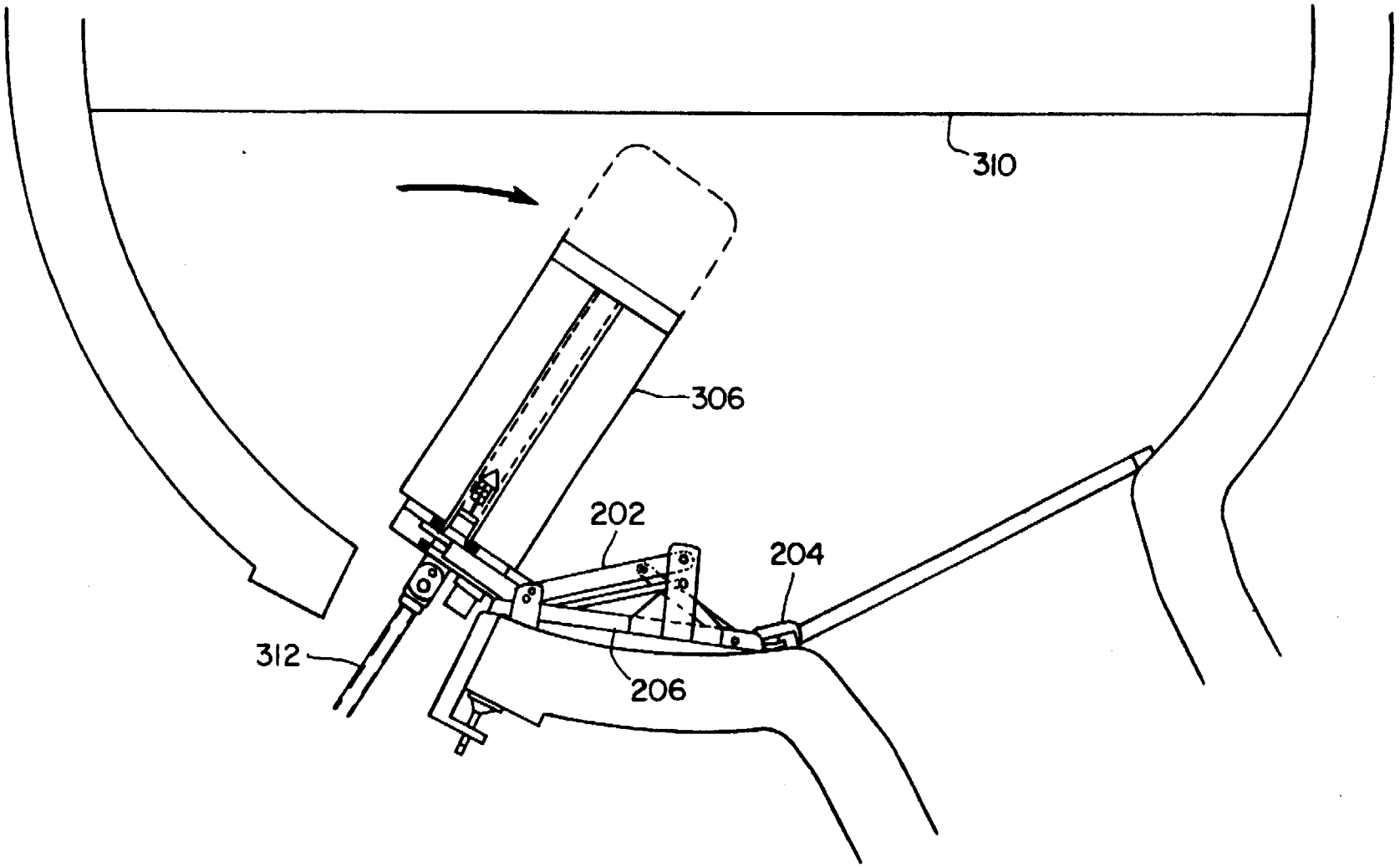
Figure 18:
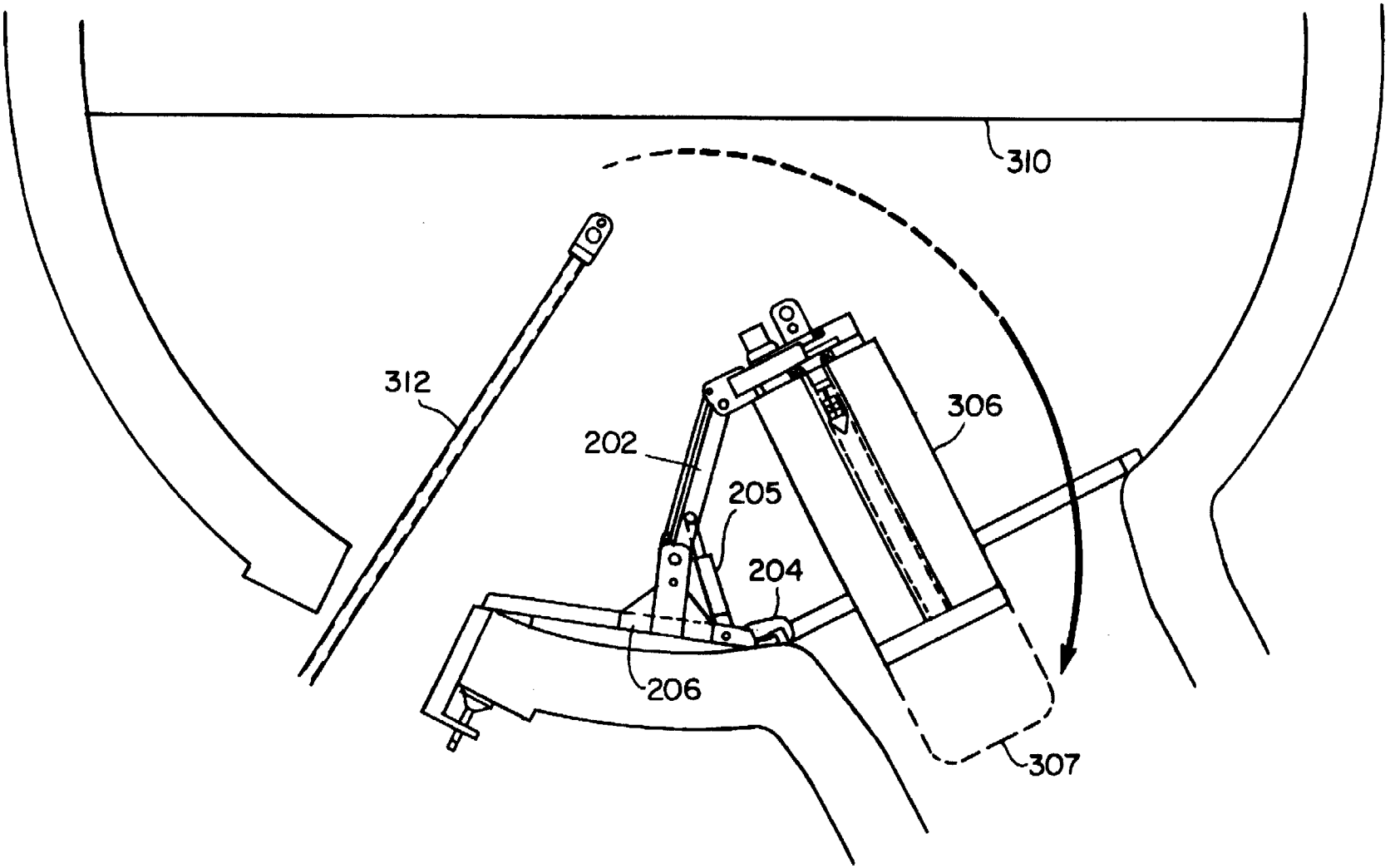
Figure 19:
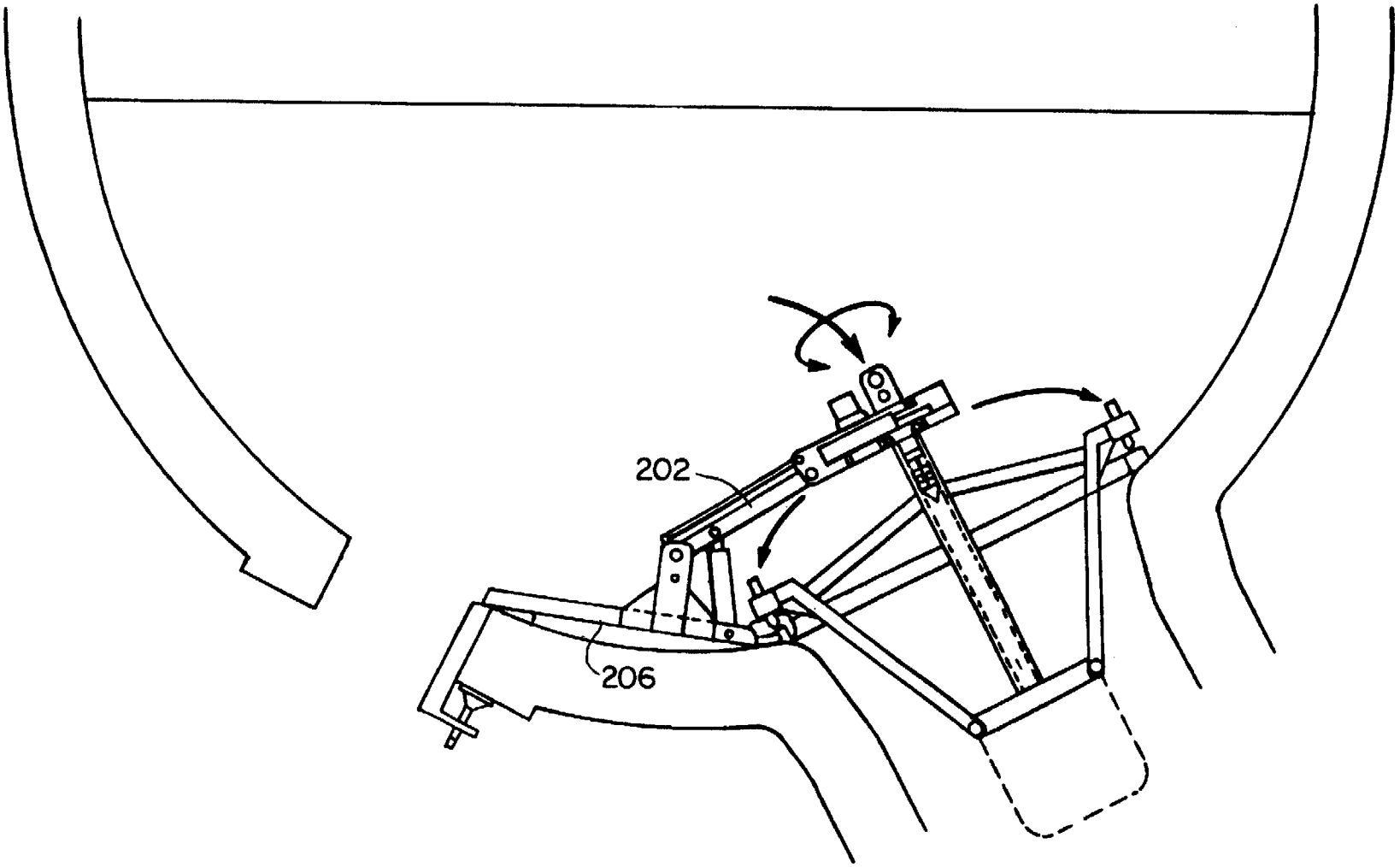

The four bar linkage is then tilted to its stop (gravity will do this automatically). This lowers the front of the dam so that it will not scrape the ceiling 310 of the steam generator bowl. Push rod 312 is then used to swing the dam over center as shown in FIGS. 17 and 18. The push rod 312 is then detached from the dam as shown in FIG. 18, and control piston 205 then lowers dam 306 down towards the nozzle as shown in FIG. 18.

Figure 6:
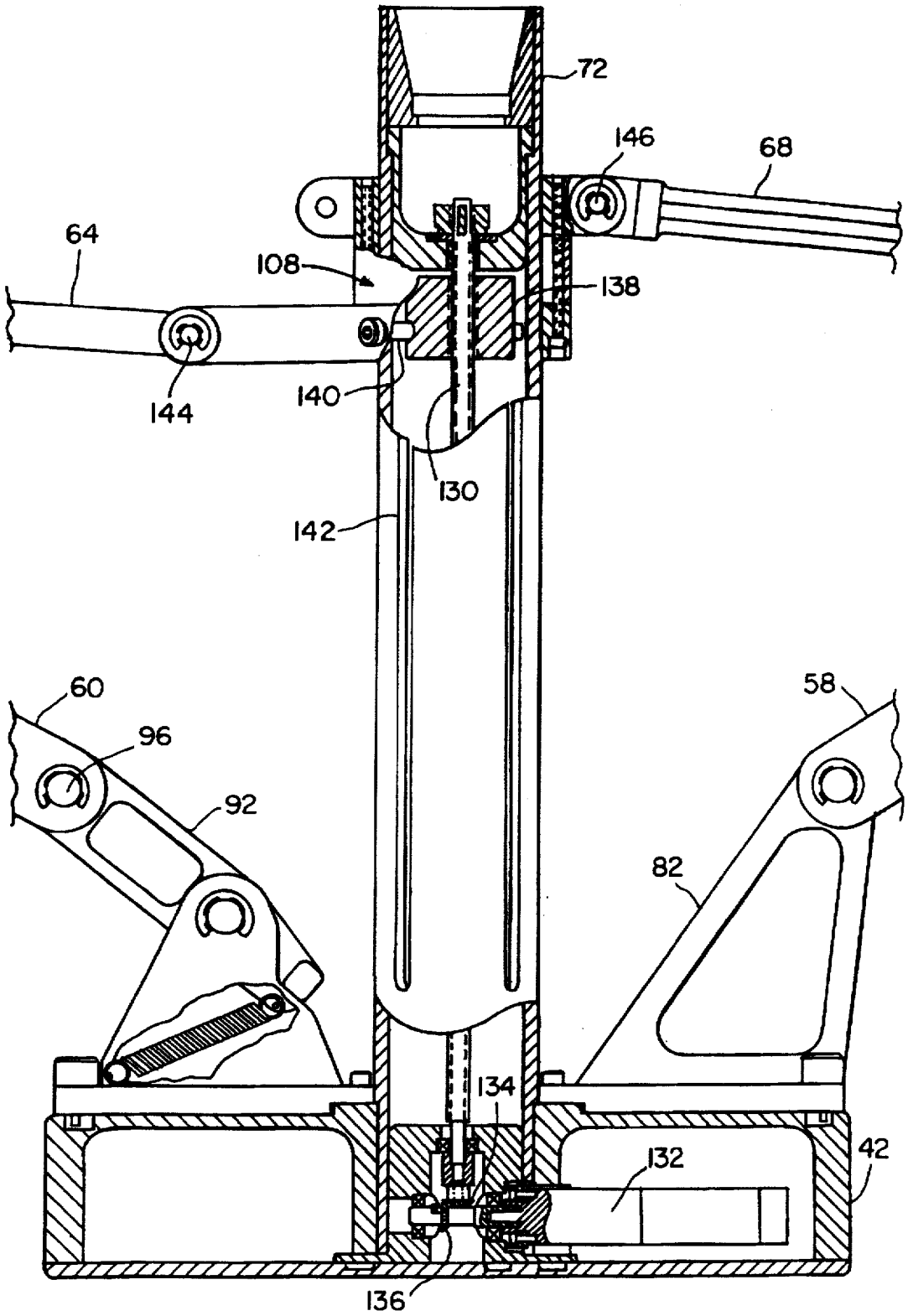
FIG. 6 is a partially cut away view of the nozzle dam of FIG. 4 showing the components which fold and unfold the nozzle dam.
Figure 20:
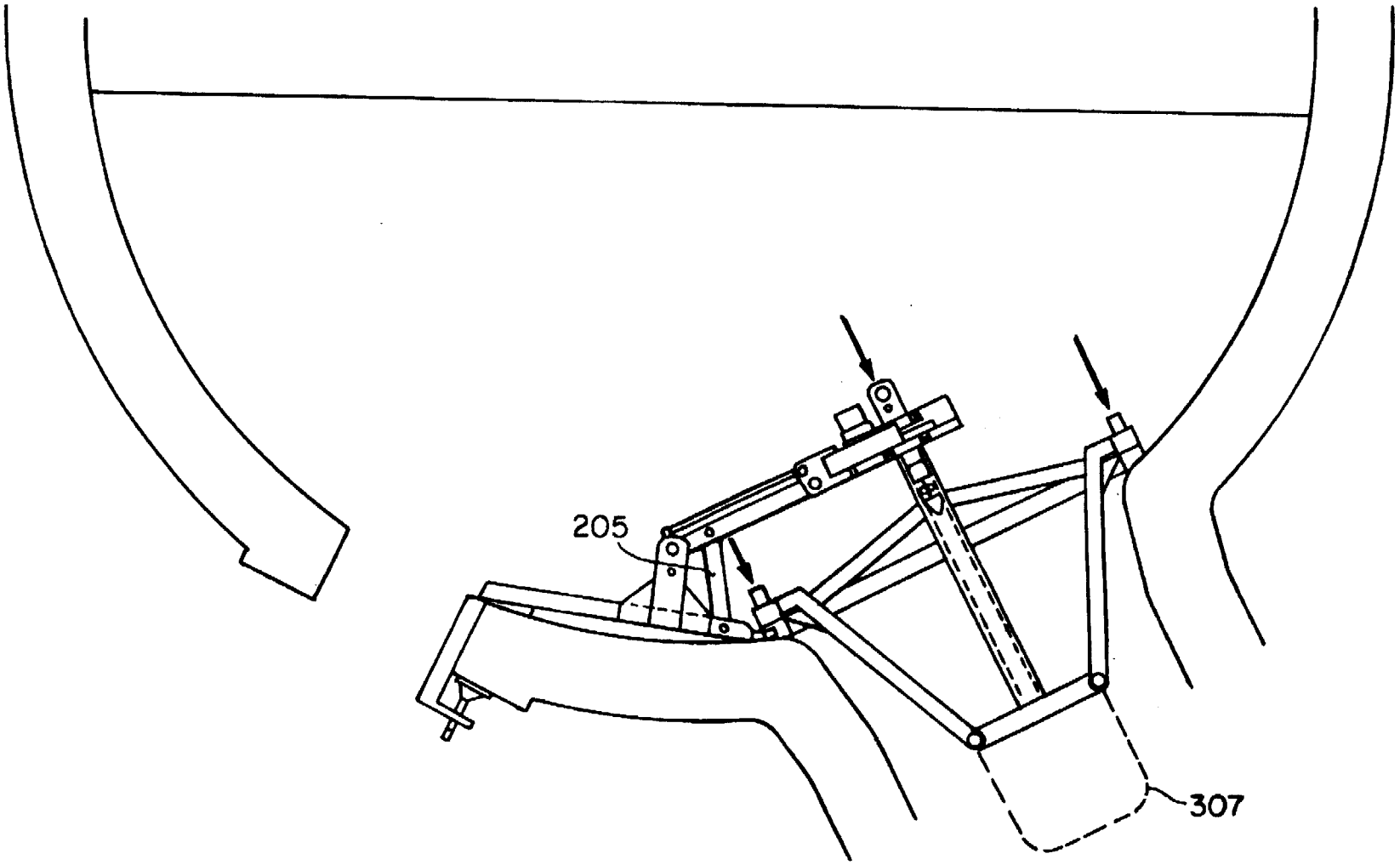
Figure 21:
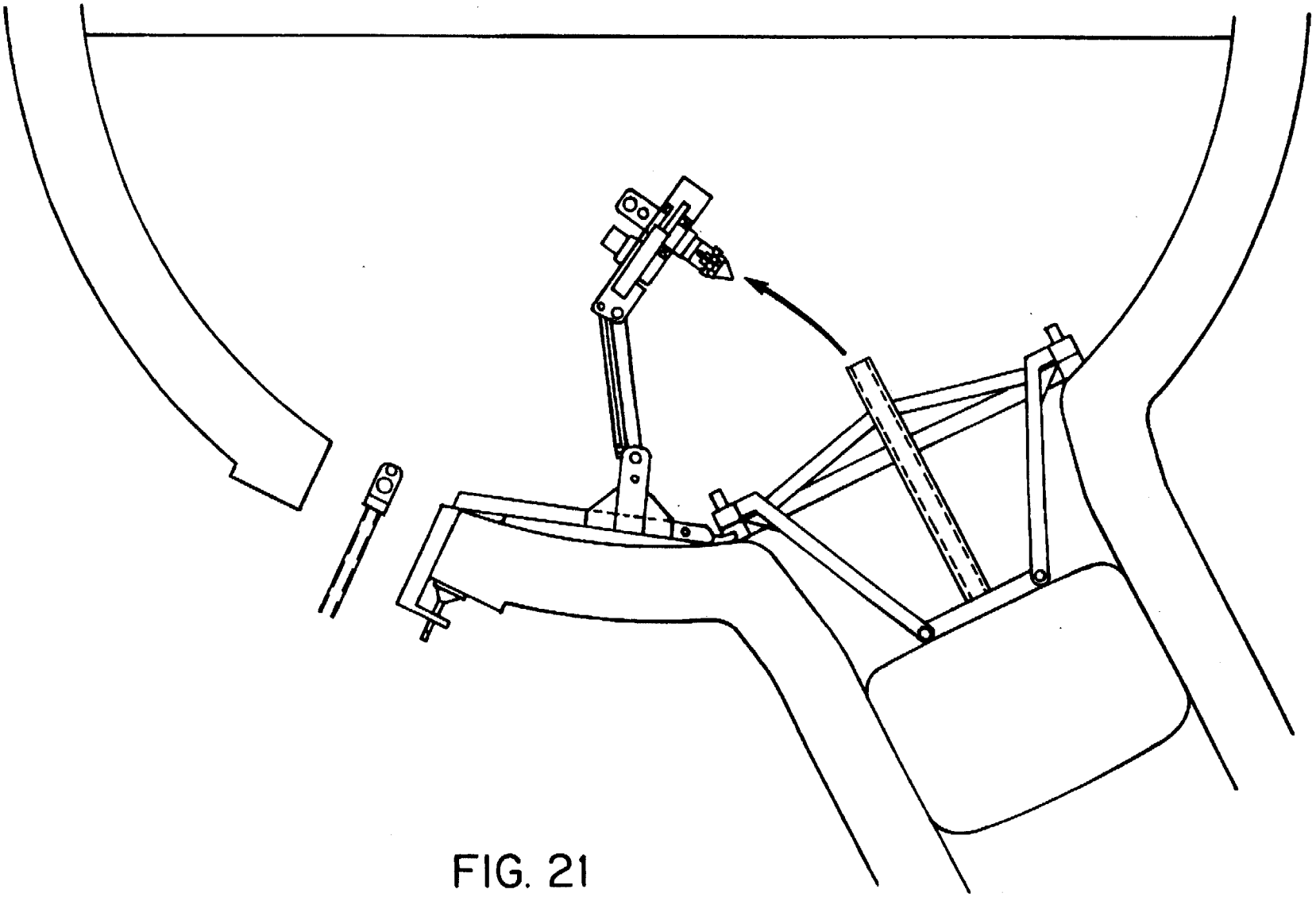

The smaller links of the four bar linkage 202 hit a stop and then the geometry of the four bar linkage dictates straight insertion. This prevents any scraping of the dam against the nozzle and possible wedge bolt or tapped hole damage due to an angular misalignment. The dam is stopped by piston 205 inches above the ring where the dam legs are to be remotely opened, FIG. 19 using the motor 132 (FIG. 6). The dam is then operated into alignment with the holes using the small dc motor and the dam backing piece. A camera on the dam backing pieces assists in the alignment as shown in FIG. 20. Piston 205 lowers the dam assembly 306 onto the ring to fully insert the wedge bolts which pneumatically engage as shown in FIG. 20. Seal bag 307 is inflated and tested as shown in FIG. 21 and the dam backing pieces are disengaged by an electric actuator and pushed back over the center by the piston. The dam backing pieces are then unfolded and removed. Finally, the dam base is unclamped and removed.

Removal of the dam is accomplished by reversing the above described procedure. The total estimated deployment time is under 30 minutes thereby greatly reducing exposure to radiation and significantly saving on the amount of down time and hence the costs associated with sealing the nozzle of a steam generator.

The other major subassembly of the system for sealing the nozzle of a steam generator according to this invention is the seal bag shown in FIGS. 20 and 21. To seal in front of the nozzle dam, a large inflatable seal is used as shown in FIG. 21. The seal bag is two inflatable chambers with a small gap between them used for monitoring for seal leakage. Once the dam is in place and the wedge bolts are actuated, the seal bag is inflated. The seal bag chamber closest to the dam structure is inflated first, and then second chamber is inflated. These chambers form themselves to the pipe wall, providing a redundant seal.

Although specific features of the invention are shown in some drawings and not others this was done for convenience only as some features may be combined with any or all of the other features in accordance with the invention.

Other embodiments will occur to those skilled in the art and are within the following claims:

What is claimed is:

1. A system for sealing the nozzle of a steam generator, comprising:

a collapsible nozzle dam, including:

a base portion receivable through a manway in the steam generator for retaining an inflatable seal in place within the nozzle, a post extending from said base portion, a plurality of foot assemblies positioned radially about said post for engaging a nozzle ring around the nozzle of the steam generator, means for supporting said foot assemblies with respect to said base portion including means for interconnecting said foot assemblies with said base portion and said post, means for folding said foot assemblies about said post for insertion thereof through the manway and for unfolding the foot assemblies once inside the steam generator for engaging the nozzle ring and positioning the base portion within the nozzle; and an installation pivot arm for transporting said collapsible nozzle dam, said installation pivot arm including:

a support having a proximal end securable to the manway of the steam generator and a distal end securable to the nozzle ring, nozzle dam attachment and positioning means, and means for articulating said nozzle dam from a position proximate the manway to a position over the nozzle and positioning the nozzle dam thereon.

2. The system of claim 1 in which at least one said foot assembly includes at least one wedge bolt subassembly comprising a threaded shaft receivable by threaded holes in the nozzle ring and a pin removably insertable in said threaded shaft.

3. The system of claim 2 in which at least one said wedge bolt subassembly further includes means for actuating and deactuating said threaded shaft.

4. The system of claim 2 in which at least one said wedge bolt subassembly includes a body portion receivable within said foot assembly for positioning said threaded shaft, said body portion having a piston cavity, a piston containing said pin, said piston residing within said piston cavity, and means for driving said piston up and down within said piston cavity for actuating and deactuating said threaded shaft.

5. The system of claim 4 in which said means for driving said piston up and down within said piston cavity includes a first inlet in said body portion having a port proximate the top of said piston for driving the piston down within said piston cavity and second inlet having a port proximate the bottom of said piston for driving the piston up within said piston cavity.

6. The system of claim 4 further including means for providing compliance for said threaded shaft along its longitudinal axis for overcoming any misalignment of the threads of the threaded shaft with the threads of the threaded hole in the nozzle ring.

7. The system of claim 6 in which said means for providing compliance includes spring means positioned within said body portion about said threaded shaft.

8. The system of claim 4 further including means for providing compliance between said body portion and the foot assembly for overcoming any axial misalignment of the threaded shaft with the holes in the nozzle ring.

9. The system of claim 8 in which said means for providing compliance between said body portion and the foot assembly includes spring means inserted between said body portion and said foot assembly.

10. The system of claim 1 in which said means for supporting said foot assemblies includes a compression leg for each foot assembly, each compression leg extending between said base portion and its associated foot assembly.

11. The system of claim 10 in which at least one said compression leg includes first pivot means for pivoting said compression leg with respect to said base portion and a second pivot means for pivoting said compression leg with respect to its associated foot assembly.

12. The system of claim 10 in which at least one compression leg includes a short link for shortening the span of travel of its associated foot assembly.

13. The system of claim 10 in which said means for interconnecting said foot assemblies with said base portion and said post further includes a tension leg assembly for each foot assembly, each tension leg assembly extending between said post and its associated foot assembly.

14. The system of claim 13 further including means for providing compliance between at least one said foot assembly and at least one said tension leg assembly.

15. The system of claim 13 further including a collar assembly slidable along said post interconnected with said tension leg assemblies.

16. The system of claim 15 in which said means for folding includes means for driving said collar assembly up and down along said post.

17. The system of claim 16 in which said means for driving includes a power driven screw residing in said post, said power driven screw including means for engaging said collar assembly for moving said collar assembly along said post as said power driven screw turns.

18. The system of claim 17 in which said driven screw is powered by a motor residing in said base portion.

19. The system of claim 1 in which said proximal end of said installation arm includes a clamp for engaging the manway opening.

20. The system of claim 1 in which said distal end of said installation arm includes at least one articulating finger for engaging the nozzle ring.

21. The system of claim 1 in which said nozzle dam attachment means includes an actuator for aligning said foot assemblies with the nozzle ring.

22. The system of claim 1 in which said means for articulating said nozzle dam attachment and positioning means includes a four bar linkage pivotably attached on one end thereof to said support and having said nozzle dam attachment and positioning means affixed to the other end thereof.

23. The system of claim 22 in which said platform is extendable to accommodate varying distances between the manway and the nozzle in different steam generators.

24. The system of claim 22 in which said means for articulating further includes a pneumatic cylinder extending between said four bar linkage and said platform.

25. The system of claim 1 in which said nozzle dam attachment and position means includes means for rotating said nozzle dam.

26. The system of claim 1 in which said nozzle dam attachment and positioning means includes means for releasably and remotely engaging said nozzle dam.

27. The system of claim 1 further including an inflatable seal attachable to said base portion of the nozzle dam for sealing the nozzle.

28. The system of claim 1 further including a push rod for urging said pivot arm into positioning for transporting the nozzle dam over to the nozzle.

29. A collapsible nozzle dam for a system for sealing the nozzle of a steam generator, said nozzle dam comprising:

a base portion receivable through the manway;

a number of pivoting arms attached to said base portion extendable to reach the periphery of a nozzle larger in diameter than the manway and foldable to fit through the manway; and a foot assembly for each said arm on the distal end thereof, each foot assembly including means for automatically engaging the periphery of the nozzle for supporting said base portion in the nozzle when said arms are extended, said means for automatically engaging including at least one wedge bolt subassembly comprising a threaded shaft receivable by threaded holes in the nozzle ring and a pin removably insertable in said threaded shaft.

30. The system of claim 29 in which at least one said wedge bolt subassembly includes a body portion receivable within said foot assembly for positioning said threaded shaft, said body portion having a piston cavity, a piston containing said pin receivable within said piston cavity, and means for driving said piston up and down within said piston cavity for actuating and deactuating said threaded shaft.

31. The system of claim 30 in which said means for driving said piston up and down within said piston cavity includes a first inlet in said body portion having a port proximate the top of said piston for driving the piston down within said piston cavity and second inlet having a port proximate the bottom of said piston for driving the piston up within said piston cavity.

32. The system of claim 30 further including means for providing compliance for said threaded shaft along its longitudinal axis for overcoming any misalignment of the threads of the threaded shaft with the threads of the a threaded hole in the nozzle ring.

33. The system of claim 32 in which said means for providing compliance includes a spring means positioned within said body portion about said threaded shaft.

34. The system of claim 30 further including means for providing compliance between said body portion and the foot assembly for overcoming any axial midalignment of the threaded shaft with the holes in the nozzle ring.

35. The system of claim 34 in which said means for providing compliance between said body portion and the foot assembly includes spring means inserted between said body portion and said foot assembly.

36. The system of claim 29 in which at least one said pivoting arm includes first pivot means for pivoting said pivoting arm with respect to said base portion and a second pivot means for pivoting said pivoting arm with respect to its associated foot assembly.

37. The system of claim 30 in which at least one said pivoting arm includes a short link for shortening the span of travel of its associated foot assembly.

38. The system of claim 30 further including a post extending from said base portion and a tension leg assembly for each foot assembly, each tension leg extending between said post and its associated foot assembly.

39. The system of claim 38 further including means for providing compliance between a foot assembly and the tension leg assembly.

40. The system of claim 38 further including a collar assembly slidable along said post interconnected with said tension leg assemblies.

41. The system of claim 40 further including means for driving said collar up and down along said post.

42. The system of claim 41 in which a said means for driving includes a power driving screw residing in said post, said screw including means engaging said collar for moving said collar along said post as said screw turns.

43. The system of claim 42 in which said screw is powered by a motor residing in said base portion.

44. An installation pivot arm for transporting a collapsible nozzle dam, said installation pivot arm comprising:

a support with a proximal end securable to a manway of a steam generator and a distal end securable to a nozzle ring;

nozzle dam attachment and positioning means; and means for articulating said nozzle dam attachment means and said nozzle dam attached thereto to between a position proximate the manway and a position over a nozzle for transporting the nozzle dam from the manway to the nozzle.

45. The device of claim 44 in which said proximal end of said installation arm includes a clamp for engaging a manway opening.

46. The device of claim 44 in which said distal end of said installation arm includes at least one articulating finger for engaging the nozzle ring.

47. The device of claim 44 in which said nozzle dam attachment means includes an actuator for aligning the nozzle dam.

48. The device of claim 44 in which said means for articulating said nozzle dam includes a four bar linkage pivotably attached on one end thereof to said support and having said nozzle dam attachment means affixed to the other end thereof.

49. The device of claim 48 in which said support is extendable to accommodate varying distances between the manway and the nozzle in different steam generators.

50. The device of claim 48 in which said means for articulating further includes a pneumatic cylinder extending between said four bar linkage and said support.

51. The device of claim 44 in which said nozzle dam attachment means includes means for rotating a nozzle dam attached thereto.

52. The device of a claim 44 in which said nozzle dam attachment means includes means for releasably and remotely engaging a nozzle dam.

53. A collapsible nozzle dam for a system for sealing the nozzle of a steam generator, said nozzle dam comprising:

a base portion receivable through the manway;

a number of pivoting arms attached to said base portion extendable to reach the periphery of a nozzle larger in diameter than the manway and foldable to fit through the manway;

a foot assembly for each said arm on the distal end thereof, each foot assembly including means for automatically engaging the periphery of the nozzle for supporting said base portion in the nozzle when said arms are extended;

a post extending from said base portion;

a tension leg assembly for each foot assembly, each tension leg extending between said post and its associated foot assembly; and means for providing compliance between at least one foot assembly and at least one tension leg assembly.

54. The system of claim 53 further including a collar assembly slidable along said post interconnected with said tension leg assemblies.

55. The system of claim 54 further including means for driving said collar up and down along said post.

56. The system of claim 53 in which a said means for driving includes a power driven screw residing in said post, said power driven screw including means engaging said collar for moving said collar along said post as said power driven screw turns.

57. The system of claim 56 in which said power driven screw is powered by a motor residing in said base portion.

* * * * *